US005911682A

United States Patent [19]

Kato et al.

[11] Patent Number: 5,911,682

[45] Date of Patent: Jun. 15, 1999

[54] AIR-FUEL RATIO CONTROL SYSTEM FOR INTERNAL COMBUSTION ENGINES

[75] Inventors: Akira Kato; Hiroki Munakata, both of Wako, Japan

[73] Assignee: Honda Giken Kogyo Kabushiki Kaisha, Tokyo, Japan

[21] Appl. No.: 08/917,679

[22] Filed: Aug. 26, 1997

[30] Foreign Application Priority Data

Aug. 29, 1996 [JP] Japan ..... 8-245461

[51] Int. Cl.[6] ..... F02D 41/00; F01N 3/28

[52] U.S. Cl. ..... 60/276; 123/673; 123/674

[58] Field of Search ..... 123/673, 674; 60/276, 285

[56] References Cited

U.S. PATENT DOCUMENTS

| | | | |
|---|---|---|---|
| 5,020,502 | 6/1991 | Wild | 123/673 |
| 5,077,970 | 1/1992 | Hamburg | 60/285 X |
| 5,083,427 | 1/1992 | Anderson | 60/285 X |
| 5,131,372 | 7/1992 | Nakaniwa | 123/674 X |
| 5,247,445 | 9/1993 | Miyano et al. | 123/674 X |
| 5,341,641 | 8/1994 | Nakajima etal. | 60/285 X |
| 5,642,722 | 7/1997 | Schumacher et al. | 123/673 |
| 5,755,094 | 5/1998 | Maki et al. | 60/276 |
| 5,758,630 | 6/1998 | Maki et al. | 123/673 |
| 5,781,875 | 7/1998 | Maki et al. | 123/673 X |
| 5,806,506 | 9/1998 | Kitamura et al. | 123/673 |
| 5,813,389 | 9/1998 | Kitamura et al. | 123/673 |
| 5,816,230 | 10/1998 | Kurokawa et al. | 123/674 |

FOREIGN PATENT DOCUMENTS

| | | |
|---|---|---|
| 2-11842 | 1/1990 | Japan . |
| 6-146998 | 5/1994 | Japan . |
| 7-247886 | 9/1995 | Japan . |

OTHER PUBLICATIONS

"Computrole", No. 27, Corona Publishing Co., Ltd., Japan, pp. 28–41.

"Automatic Control Handbook" OHM, Ltd., Japan, pp. 703–707.

"A Survey of Model Reference Adaptive Techniques—Theory and Application", I.D. Landau Automatica, vol. 10, pp. 353–379, 1974.

"Unification of Discrete Time Explicit Model Reference Adaptive Control Designs", I.D. Landau et al., Automatica, vol. 17, No. 4, pp. 593–611, 1981.

"Combining Model Reference Adaptive Controllers and Stochastic Self–tuning Regulators", I.D. Landau, Automatica, vol. 18, No. 1, pp. 77–84, 1992.

*Primary Examiner*—John E. Ryznic

*Attorney, Agent, or Firm*—Nikaido Marmelstein Murray & Oram, LLP

[57] ABSTRACT

An air-fuel ratio control system for an internal combustion has a plurality of cylinders and an exhaust system. The air-fuel ratio of exhaust gases emitted from the cylinders is detected by an air-fuel ratio sensor arranged in the exhaust system. The air-fuel ratio of a mixture supplied to each of the cylinders is estimated based on an output from the air-fuel ratio sensor by using an observer for observing an internal operative state of the exhaust system by means of a model representative of a behavior of the exhaust system. Feedback control of an amount of fuel to be supplied to the each of the cylinders is carried out in response to the output from the air-fuel ratio sensor by using a controller of a recurrence formula type, such that the air-fuel ratio of the mixture supplied to the each of the cylinders is converged to a desired value. The controller of the recurrence formula type adjusts adaptive parameters for use in the feedback control, for the each of the cylinders based on the estimated air-fuel ratio.

6 Claims, 16 Drawing Sheets

ECU
IG
TW
LAF
O2
PBA
θTH
TA
PA
SPN
ECU5
1
2
3
4
5
6
7
8
9
10
11
12
13
14
15
16
17
18
19
20
21
22
23
60
70

NE
PBA
θTH
PA
B1
TIMF
B2
B3
B4
B5
B6
B7
B8
B9
KTOTAL
KCMDM
1
ENG
TOUT
TOUT
TOUT
TOUT
KOBSV#1
KOBSV#3
KOBSV#4
KOBSV#2
B12
B14
B15
B13
PID
PID
PID
PID
KCMD
B11
OBSV
B17
B16
B19
B18
LPF
LPF
STR
PID
KSTR
KLAF
KCMD
B20
SW
KFB
B10
SELV
22
LPF
17
LAF
19
CAT
20
CAT
18
O2
23
LPF
B21
KCMD
B22
MIDO2
FB
KCMD
B23
KCMDM

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind which controls the air-fuel ratio of a mixture supplied to the engine in a feedback manner, by applying an adaptive control theory thereto.

2. Prior Art

Conventionally, there has been proposed an air-fuel ratio control system for internal combustion engines based on an adaptive control theory, e.g. by Japanese Laid-Open Patent Publication (Kokai) No. 7-247886, which calculates an adaptive control correction coefficient in response to an output from an air-fuel ratio sensor arranged in the exhaust system of the engine by the use of an adaptive controller provided with a parameter-adjusting mechanism of a recurrence formula type, to thereby correct the amount of fuel supplied to the engine to feedback-control the air-fuel ratio of the mixture supplied to the engine.

However, in the conventional air-fuel ratio control system, the adaptive control correction coefficient is commonly used for all the cylinders, so that it is impossible to carry out the air-fuel ratio feedback control in a manner adapted to variations in characteristics between the cylinders. If the adaptive control correction coefficient is set cylinder by cylinder to overcome the above inconvenience, however, due to the fact that an output signal from the air-fuel ratio sensor which is arranged at a confluent portion of the exhaust system of the engine is input to the parameter-adjusting mechanism for adjustment of adaptive parameters, there arises the following problem:

Individual cylinders of the engine to be controlled by the air-fuel ratio control system are different from each other in operating characteristics in a strict sense, and therefore, when the adaptive parameters are adjusted based on the output signal from the air-fuel ratio sensor, the variations in the operating characteristics between the cylinders are not appropriately reflected in the adaptive parameters. Therefore, the conventional air-fuel ratio control system remains to be improved in respect of the controllability of the air-fuel ratio.

SUMMARY OF THE INVENTION

It is the object of the invention to provide an air-fuel ratio control system for an internal combustion engine, which is capable of properly calculating adaptive parameters of an adaptive controller to thereby achieve enhanced controllability of the air-fuel ratio of a mixture supplied to the engine.

To attain the above object, the invention provides an air-fuel ratio control system for an internal combustion engine having a plurality of cylinders, and an exhaust system, the air-fuel ratio control system including:

air-fuel ratio-detecting means arranged in the exhaust system, for detecting an air-fuel ratio of exhaust gases emitted from the cylinders;

cylinder-by-cylinder air-fuel ratio-estimating means for estimating an air-fuel ratio of a mixture supplied to each of the cylinders, based on an output from the air-fuel ratio-detecting means by using observing means for observing an internal operative state of the exhaust system by means of a model representative of a behavior of the exhaust system; and feedback control means for carrying out feedback control of an amount of fuel to be supplied to the each of the cylinders in response to the output from air-fuel ratio-detecting means by using a controller of a recurrence formula type, such that the air-fuel ratio of the mixture supplied to the each of the cylinders is converged to a desired value.

The air-fuel ratio control system according to the invention is characterized in that the controller of the recurrence formula type has parameter-adjusting means for adjusting adaptive parameters for use in the feedback control, the parameter-adjusting means adjusting the adaptive parameters for the each of the cylinders, based on the air-fuel ratio estimated by the cylinder-by-cylinder air-fuel ratio-estimating means.

Preferably, the controller of the recurrence formula type calculates an adaptive correction coefficient as a control amount of the feedback control of the air-fuel ratio, for the each of the cylinders, in response to the air-fuel ratio estimated by the cylinder-by-cylinder air-fuel ratio-estimating means, the parameter-adjusting means adjusting the adaptive parameters for the each of the cylinders, based on the air-fuel ratio estimated by the cylinder-by-cylinder air-fuel ratio-estimating means and the adaptive correction coefficient calculated for the each of the cylinders by the controller and corresponding to the air-fuel ratio estimated by the cylinder-by-cylinder air-fuel ratio-estimating means.

More preferably, the feedback control means calculates the desired value of the air-fuel ratio of the mixture for the each of the cylinders, and carries out the feedback control of the air-fuel ratio of the mixture supplied to the each of the cylinders by using the calculated desired value together with the air-fuel ratio estimated by the cylinder-by-cylinder air-fuel ratio-estimating means corresponding to the desired value.

Preferably, the cylinder-by-cylinder air-fuel ratio-estimating means estimates the air-fuel ratio of the mixture supplied to the each of the cylinders, by using a time constant of response delay of the air-fuel ratio-detecting means.

More preferably, the engine has an intake passage, the air-fuel ratio control system including pressure-detecting means arranged in the intake passage for detecting pressure within the intake passage, the air-fuel ratio control system including and engine rotational speed-detecting means for detecting rotational speed of the engine, the time constant being set according to the rotational speed of the engine and the pressure within the intake passage.

Preferably, the air-fuel ratio control system includes second feedback control means for controlling the amount of fuel supplied to the each of the cylinders in a feedback manner responsive to the output from the air-fuel ratio-detecting means with a response speed lower than a response speed of the feedback control means for carrying out the feedback control by using the controller of the recurrence formula type, in a manner such that the air-fuel ratio of the mixture supplied to the each of the cylinders is converged to the desired value, and selecting means for selecting one of the feedback controls means for carrying out the feedback control by using the controller of the recurrence formula type and the second feedback control means, depending upon operating conditions of the engine.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
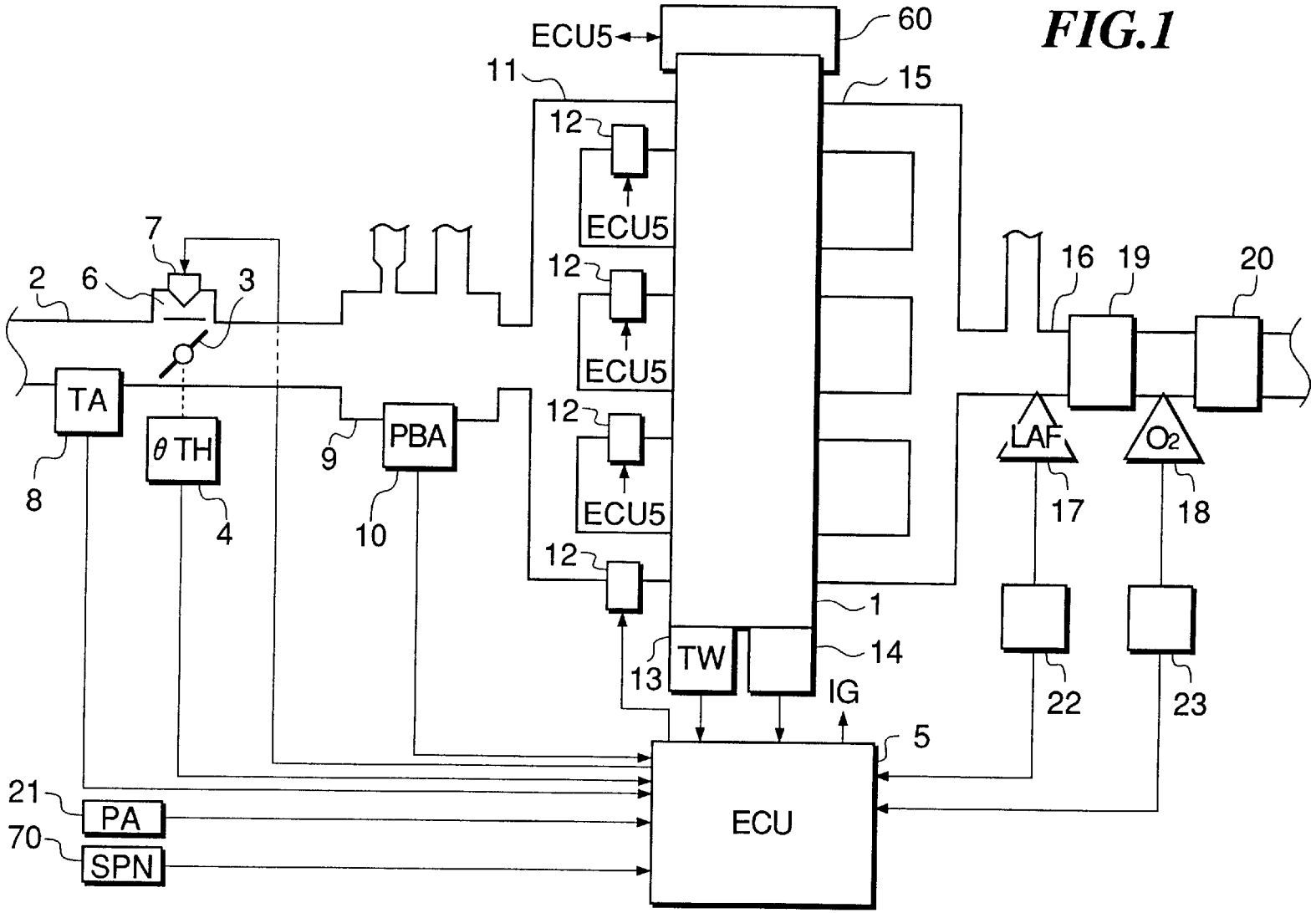
FIG. 1 is a block diagram showing the arrangement of an internal combustion engine incorporating an air-fuel ratio control system therefor, according to an embodiment of the invention.

Referring first to FIG. 1, there is shown the whole arrangement of a DOHC straight type four-cylinder internal combustion engine (hereinafter simply referred to as "the engine") and an air-fuel ratio control system therefor, according to an embodiment of the invention. In the figure, reference numeral 1 designates the engine.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3 for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged in the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3 for supplying an electric signal indicative of the sensed intake air temperature TA to the ECU 5. The intake pipe 2 has a thickened portion 9 as a chamber interposed between the throttle valve 3 and the intake manifold 11. An intake pipe absolute pressure (PBA) sensor 10 is arranged in the chamber 9 for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying signals corresponding to the rotational angle of the crankshaft to the ECU 5. The crank angle position sensor 14 is comprised of a cylinder-discriminating sensor which generates a pulse (hereinafter referred to as "the CYL signal pulse") at a predetermined crank angle position of a particular cylinder of the engine 1 before a TDC position of the cylinder corresponding to the start of the intake stroke of the cylinder, a TDC sensor which generates a pulse (hereinafter referred to as "the TDC signal pulse") at a predetermined crank angle position of each cylinder a predetermined angle before the TDC position (whenever the crankshaft rotates through 180 degrees in the case of a four-cylinder engine), and a CRK sensor which generates a pulse (hereinafter referred to as "the CRK signal pulse") at each of predetermined crank angle positions whenever the crankshaft rotates through a predetermined angle (e.g. 30 degrees) smaller than the rotational angle interval of generation of the TDC signal pulse. The CYL signal pulse, the TDC signal pulse and the CRK signal pulse are supplied to the ECU 5. These signal pulses are used for timing control in carrying out operations of the control system for determining fuel injection timing, ignition timing, etc., as well as for detecting the engine rotational speed NE.

Fuel injection valves 12 for respective cylinders are inserted into the intake manifold 11 at locations slightly upstream of intake valves, not shown, of the respective cylinders. The fuel injection valves 12 are connected to a fuel pump, not shown, and electrically connected to the ECU 5 to have their valve opening periods (fuel injection periods) and fuel injection timing controlled by signals therefrom. The engine 1 has spark plugs, not shown, provided for respective cylinders and electrically connected to the ECU 5 to have ignition timing θIG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17 for purifying noxious components such as HC, CO, and NOx. An oxygen concentration sensor (hereinafter referred to as "the O2 sensor") 18 is arranged between the three-way catalysts 19 and 20.

As the linear output air-fuel ratio sensor 17 is used a LAF sensor as disclosed e.g. by Japanese Laid-Open Patent Publication (Kokai) No. 2-11842 filed by the present assignee. The LAF sensor 17 has a wide range output characteristic that its output changes linearly to the concentration of oxygen in exhaust gases from the engine 1.

The LAF sensor 17 is electrically connected via a low-pass filter 22 to the ECU 5 for supplying the ECU 5 with an electric signal substantially proportional in value to the concentration of oxygen in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with the high or low level signal.

Arranged between the engine 1 and wheels, not shown, of a vehicle on which the engine 1 is installed is an automatic transmission, not shown, for transmitting torque generated by the engine 1 to the vehicle. The automatic transmission is comprised of a fluid clutch, etc. By operating a shift lever, not shown, the gear shift position can be changed to a P range, an N range, or a D range.

The automatic transmission has a shift position sensor (SPN) 70 for detecting the gear shift position, and an electric signal indicative of the sensed shift position is supplied to the ECU 5.

The wheels of the vehicle are provided with wheel speed sensors, not shown, for detecting rotational speeds of driving wheels and trailing wheels. Electric signals indicative of the sensed rotational speeds of the wheels are supplied to the ECU 5. The ECU 5 determines, based on the detected rotational speeds of the driving and trailing wheels, whether or not the driving wheels are in an excessive slip state. If an excessive slip state of the driving wheels is detected, the ECU carries out traction control by making lean the air-fuel ratio of the mixture supplied to the engine or interrupting fuel supply to part of the cylinders, or by largely retarding the ignition timing.

The engine 1 includes a valve timing changeover mechanism 60 which changes valve timing of the intake valves and exhaust valves, or at least the intake valves alone, between a high speed valve timing suitable for a high speed operating region of the engine and a low speed valve timing suitable for a low speed operating region of the same. The changeover of the valve timing includes not only timing of opening and closing of the valve but also changeover of the valve lift amount, and further, when the low speed valve timing is selected, one of the two intake valves is rendered inoperative, thereby ensuring stable combustion within the combustion chamber even when the air-fuel ratio of the mixture is controlled to a leaner value than the stoichiometric air-fuel ratio.

The valve timing changeover mechanism 60 carries out changeover of the valve timing by means of changeover of hydraulic pressure for operating the valve, and includes an electromagnetic valve and an oil pressure sensor, neither of which is shown, which cooperate to effect the changeover of the hydraulic pressure. A signal from the oil pressure sensor is supplied to the ECU 5, and the ECU 5 controls the operation of the electromagnetic valve to effect changeover of the valve timing.

An atmospheric pressure (PA) sensor 21 is electrically connected to the ECU 5 for detecting atmospheric pressure PA, and supplying a signal indicative of the sensed atmospheric pressure PA to the ECU 5.

The ECU 5 is comprised of an output circuit having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU"), a memory device comprised of a ROM storing various operational programs which are executed by the CPU and various maps and tables, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors including the LAF sensor 17 and the O2 sensor 18 to determine various operating conditions in which the engine 1 is operating, such as an air-fuel ratio feedback control region in which the air-fuel ratio is controlled in response to outputs from the LAF sensor 17 and the O2 sensor 18, and open-loop control regions other than the feedback control region, and calculates, based upon the determined operating conditions, the valve opening period or fuel injection period TOUT over which the 13 fuel injection valves 12 are to be opened, by the use of the following equation (1) in synchronism with inputting of TDC signal pulses to the ECU 5, to deliver driving signals to the fuel injection valves 12, which are based on results of the calculation:

$$TOUT(N)=TIMF\times KTOTAL\times KCMDM\times KFB\times KOBSV\#N \quad (1)$$

The symbols of the equation (1) will be explained in the following description of FIG. 2.

Figure 2:
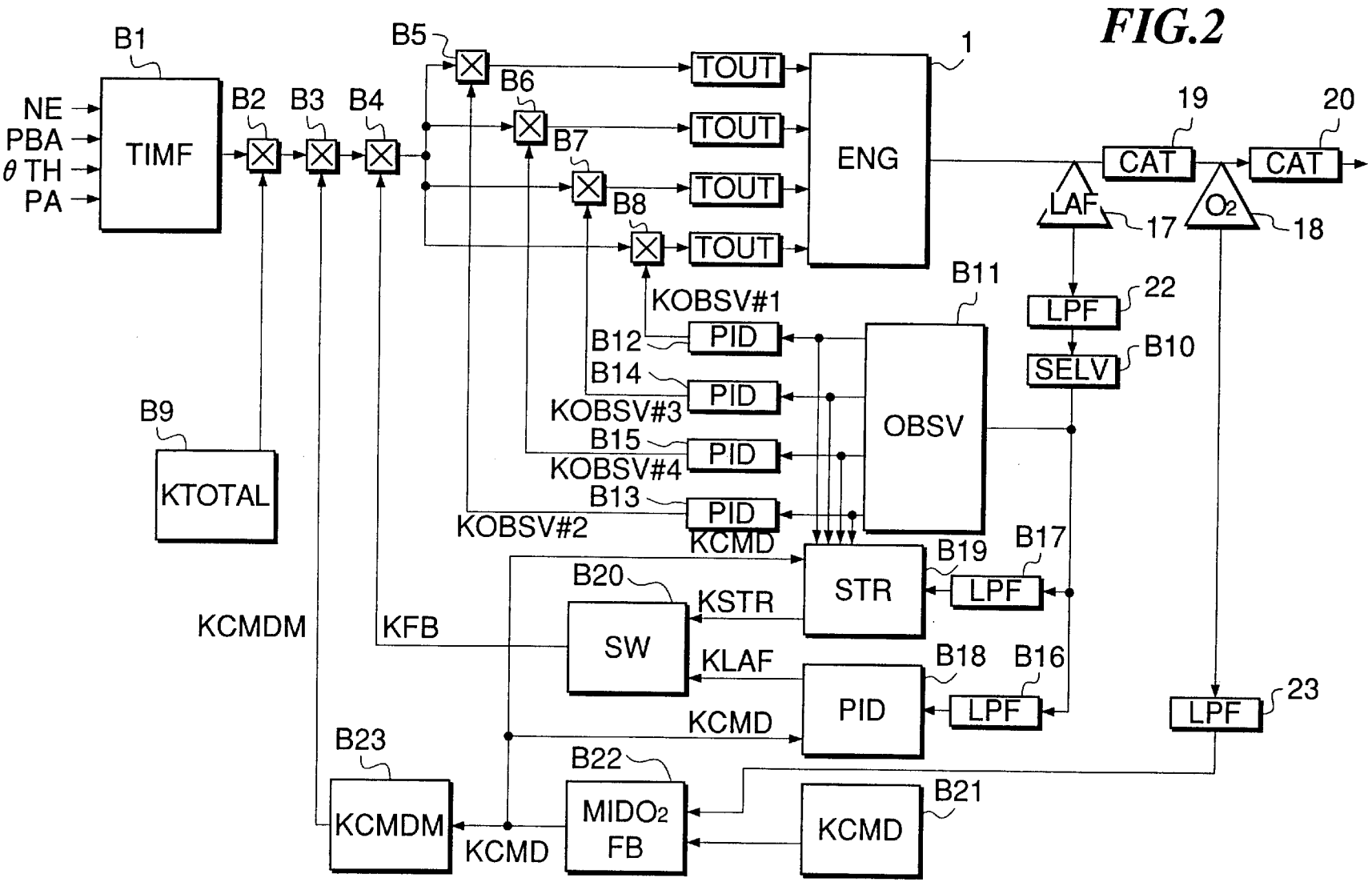
FIG. 2 is a block diagram useful in explaining the functions of the air-fuel ratio control system and a manner of controlling the air-fuel ratio of a mixture supplied to the engine.

FIG. 2 shows a block diagram which is useful in explaining a manner of calculation of the fuel injection period TOUT(N) by the use of the equation (1). With reference to the figure, an outline of the manner of calculation of the fuel injection period TOUT(N) according to the present embodiment will be described. The suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 12 is opened (fuel injection period), but in the present specification, the fuel injection period TOUT(N) is referred to as the fuel injection amount or the fuel amount since the fuel injection period is equivalent to the amount of fuel injected or to be injected.

In FIG. 2, a block B1 calculates a basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In the preferred method, the throttle valve opening θTH and the atmospheric pressure PA are also used as additional parameters indicative of operating conditions of the engine.

Reference numerals B2 to B8 designate multiplying blocks, which each multiply the basic fuel 10 amount TIMF by parameter values input thereto, and deliver the product values. These blocks carry out the arithmetic operation of the equation (1), and outputs from the multiplying blocks B5 to B8 provide fuel injection amounts TOUT(N) for the respective cylinders.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of exhaust gas recirculation, and a purge-dependent correction coefficient KPUG set according to the amount of purged fuel during execution of purging of evaporative fuel by an evaporative emission control system, not shown, to obtain the correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e., the fuel-air ratio F/A, and assumes a value of 1. 0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to a block B18, a block B19 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, stores the sampled values sequentially into a ring buffer memory, not shown, and selects one of the stored values depending on operating conditions of the engine (LAF sensor output-selecting processing), which was sampled at the optimum timing for each cylinder, to supply the selected value directly to a block B11 and to the block B18 and the block B19 via low-pass filter blocks B16 and B17. The LAF sensor output-selecting processing eliminates the inconveniences that the air-fuel ratio, which changes every moment, cannot be accurately detected depending on the timing of sampling of the output from the LAF sensor 17 since, there is a time lag before exhaust gases emitted from the combustion chamber reach the LAF sensor 17, and since the response time of the LAF sensor per se changes depending on operating conditions of the engine.

The block B11 has the function of a so-called observer, estimates a value of the air-fuel ratio separately for each cylinder from the air-fuel ratio detected at the confluent portion of the exhaust system (from a mixture of exhaust gases emitted from the cylinders) by the LAF sensor 17, and supplies the estimated value to a corresponding one of blocks B12 to B15 associated respectively, with the four cylinders and the block B19. In FIG. 2, the block B12 corresponds to a cylinder #1, the block B13 to a cylinder #2, the block B14 to a cylinder #3, and the block B15 to a cylinder #4. The blocks B12 to B15 each calculate the cylinder-by-cylinder correction coefficient KOBSV#N(N=1 to 4) through PID control such that the air-fuel ratio of each cylinder (the value of the air-fuel ratio estimated by the observer B11 for each cylinder) becomes equal to a value of the air-fuel ratio detected at the confluent portion, and supplies the calculated values to the blocks B5 to B8, respectively.

The block B18 calculates a PID correction coefficient KLAF through PID control based on the difference between the actual air-fuel ratio and the desired air-fuel ratio and delivers the calculated KLAF value to the block B20. The block B19 calculates an adaptive control correction coefficient KSTR through adaptive control (Self-Tuning Regulation), based on the air-fuel ratio detected by the LAF sensor and the cylinder-by-cylinder air-fuel ratio estimated by the observer block B11, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the detected air-fuel ratio may become dull due to a response lag of the engine. The adaptive control is employed to dynamically compensate for the response lag of the engine to thereby improve the toughness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as a feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the feedback correction coefficient KFB to the equation (1) to calculate the fuel injection amount TOUT. When the correction coefficient KSTR is applied, the responsiveness of the air-fuel ratio control exhibited when the desired air-fuel ratio is changed or the actual air-fuel ratio is changed and the toughness of the air-fuel ratio control against external disturbances can be improved, and hence the purification rate of the catalysts can be improved to ensure excellent exhaust emission characteristics of the engine in various operating conditions of the engine. Further, the cylinder-by-cylinder correction coefficient KOBSV#N, which is set according to the air-fuel ratio value of each cylinder estimated based on the output from the LAF sensor 17, is also applied to the equation (1) to calculate the cylinder-by-cylinder fuel injection amount TOUT(N). Variations in the air-fuel ratio between the cylinders can be eliminated by the use of the cylinder-by-cylinder correction coefficient KOBSV#N to thereby improve the purifying efficiency of the catalysts and hence achieve excellent exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
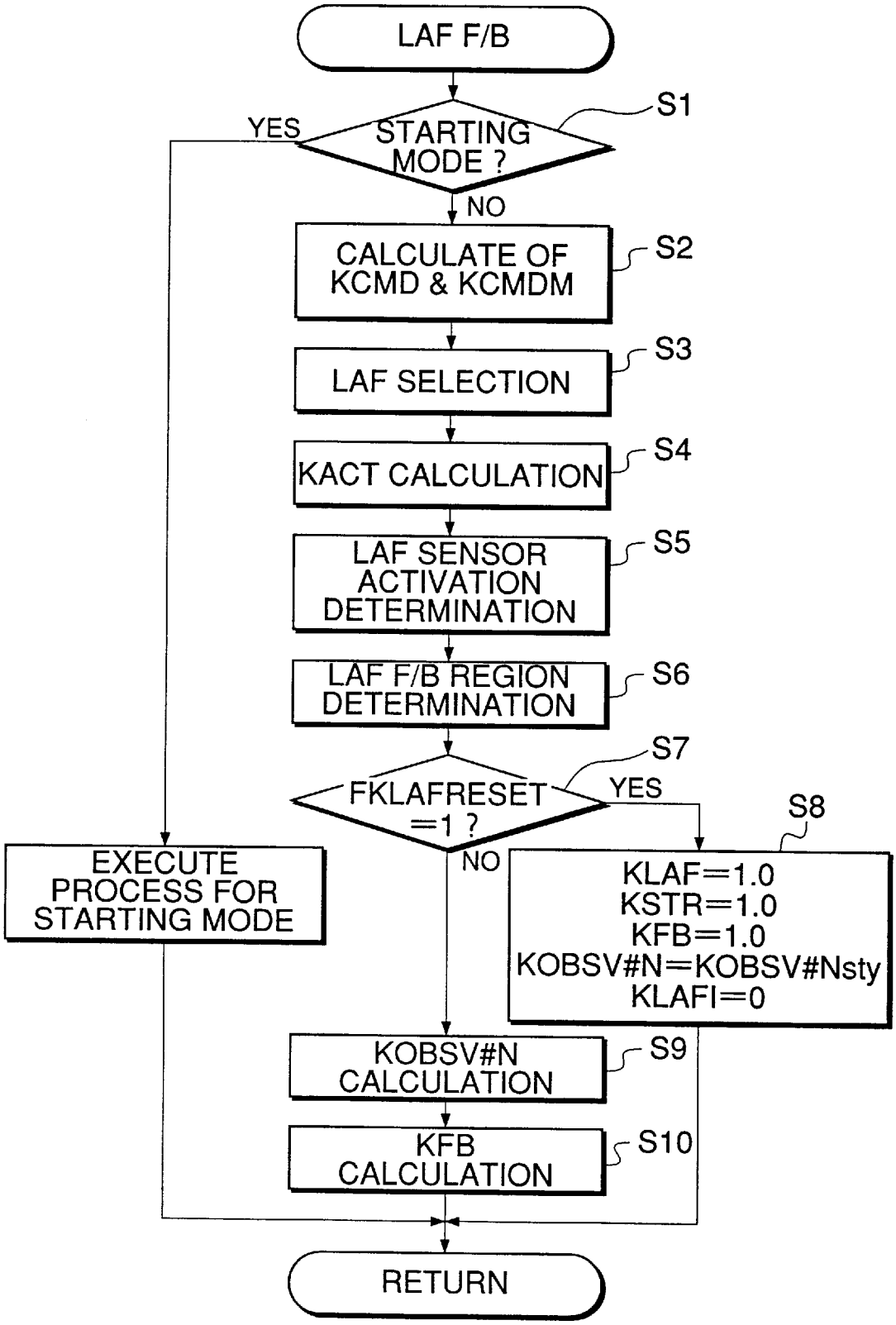
FIG. 3 is a flowchart showing a routine for calculating a PID correction coefficient KLAF and a cylinder-by-cylinder correction coefficient KOBSV#N in response to an output from a LAF sensor appearing in FIG. 1.

FIG. 3 shows a routine for calculating the PID correction coefficient KLAF, the adaptive control correction coefficient KSTR, and finally the feedback correction coefficient KFB according to the output from the LAF sensor, while calculating the cylinder-by-cylinder correction coefficient KOBSV#N according to the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S11 to execute a subroutine for the starting mode. If the engine is not in the starting mode, the desired air-fuel ratio coefficient (desired equivalent ratio) KCMD and the final desired air-fuel ratio coefficient KCMDM are calculated at a step S2, and the LAF sensor output-selecting processing is executed at a step S3. Further, the actual equivalent ratio KACT is calculated at a step S4. The actual equivalent ratio KACT is obtained by converting the output from the LAF sensor to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined at this step that the engine is not in the LAF feedback control region, a reset flag FKLAFRESET, which, when set to "1", indicates that the feedback control based on the output from the LAF sensor should be stopped, is set to "1", whereas if it is determined that the engine is in the LAF feedback control region, the reset flag FKLAFRESET is set to "0".

At the following step S7, it is determined whether or not the reset flag FKLAFRESET assumes "1". If FKLAFRESET=1 holds, the program proceeds to a step S8, wherein the PID correction coefficient KLAF, the adaptive control correction coefficient KSTR and the feedback correction coefficient KFB are all set to "1.0", the cylinder-by-cylinder correction coefficient KOBSV#N is set to a learned value KOBSV#Nsty thereof, and an integral term KLAFI of the PID control is set to "0", followed by terminating the present program. On the other hand, if FKLAFRESET=0 holds, the cylinder-by-cylinder air-fuel ratio correction coefficient KOBSV#N and the feedback correction coefficient KFB are calculated at steps S9 and S10, followed by terminating the present program.

Figure 4:
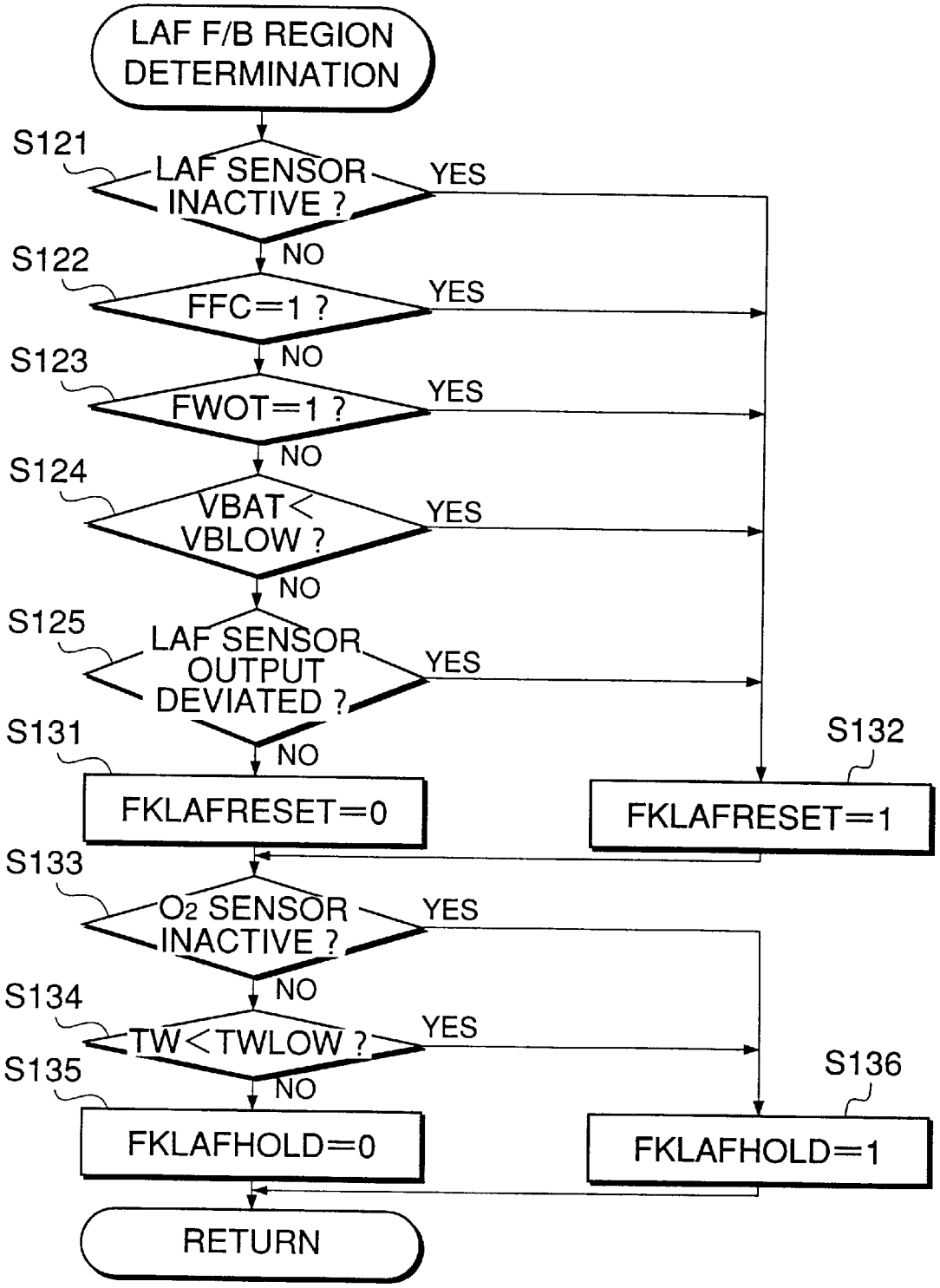
FIG. 4 is a flowchart showing a subroutine for determining whether the engine is operating in a LAF feedback control region, which is executed at a step S6 in FIG. 3.

FIG. 4 shows a LAF feedback control region-determining routine, which is executed at the step S6 of the FIG. 3.

First, at a step S121, it is determined whether or not the LAF sensor 17 is inactive. If the LAF sensor 17 is inactive, it is determined at a step S122 whether or not a flag FFC, which, when set to "1", indicates that fuel cut is being carried out, assumes "1". If FFC=0 holds, it is determined at a step S123 whether or not a WOT flag FWOT, which, when set to "1", indicates that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the aforementioned reset flag FKLAFRESET is set to "1" at a step S132.

On the other hand, if all the answers to the questions of the steps S121 to S125 are negative (NO), it is regarded that the feedback control based on the output from the LAF sensor can be carried out, and then the reset flag FKLAFRESET is set to "0" at a step S131.

At the following step S133, it is determined whether or not the O2 sensor 18 is inactive. If the O2 sensor 18 is inactive, it is determined at a step 134 whether or not the engine coolant temperature TW is lower than a predetermined lower limit value TWLOW (e.g. 0° C.). If the O2 sensor 18 is inactive or if TW<TWLOW holds, a hold flag FKLAFHOLD, which, when set to "1", indicates that the PID correction coefficient KLAF should be held at the present value, is set to "1" at a step S136, followed by terminating the program. If the O2 sensor 18 is active and at the same time TW≧TWLOW holds, the hold flag FKLAFHOLD is set to "0" at a step S135, followed by terminating the program.

Next, a subroutine for calculating the cylinder-by-cylinder correction coefficient KOBSV#N, which is executed at the step S9 in FIG. 3, will be described.

First, a manner of estimation of the cylinder-by-cylinder air-fuel ratio by the observer will be described, and then a manner of calculating the cylinder-by-cylinder correction coefficient KOBSV#N based on the estimated cylinder-by-cylinder air-fuel ratio will be described.

The air-fuel ratio detected at the confluent portion of the exhaust system is regarded as a weighted average value of air-fuel ratio values of individual cylinders, which reflects time-dependent contributions of all the cylinders, whereby values of the air-fuel ratio detected at time points (k), (k+1), (k+2) are expressed by equations (2A), (2B), and (2C), respectively. In preparing these equations, the fuel amount (F) was used as an operation amount, and accordingly the fuel-air ratio F/A is used in these equations:

$$[F/A](k)=C1[F/A\#1]+C2[F/A\#3]+C3[F/A\#4]+C4[F/A\#2] \quad (2A)$$

$$[F/A](k+1)=C1[F/A\#3]+C2[F/A\#4]+C3[F/A\#2]+C4[F/A\#1] \quad (2B)$$

$$[F/A](k+2)=C1[F/A\#4]+C2[F/A\#2]+C3[F/A\#1]+C4[F/A\#3] \quad (2C)$$

Figure 5:
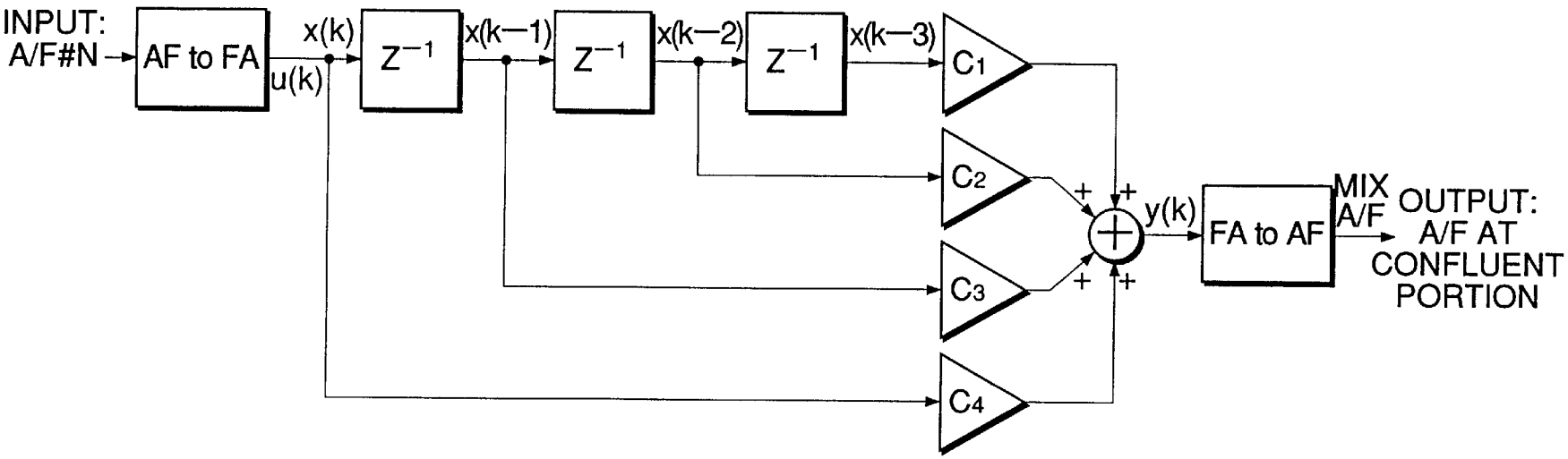
FIG. 5 is a block diagram showing a model representative of a behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in block diagrams as shown in FIG. 5, and the state equation therefor is expressed by the following equation (3):

$$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{3}$$

Further, if the fuel-air ratio detected at the confluent portion is designated by y(k), the output equation can be expressed by the following equation (4):

$$y(k) = [C_1 C_2 C_3] \begin{bmatrix} x(k-3) \\ x(k-2) \\ x(k-1) \end{bmatrix} + C_4 u(k) \tag{4}$$

where, C1: 0.05, C2: 0.15, C3: 0.30, C4: 0.05.

In the equation (4), u(k) cannot be observed, and hence an observer designed based on this state equation cannot enable observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (4) can be changed into the following formula (5):

$$y(k) = [C_1 C_2 C_3 C_4] \begin{bmatrix} x(k-3) \\ x(k-2) \\ x(k-1) \\ x(k) \end{bmatrix} \tag{5}$$

It was experimentally ascertained that the above model accurately represents the exhaust system of the four-cylinder engine. Therefore, a problem arising from estimating the cylinder-by-cylinder air-fuel ratio from the air-fuel ratio A/F detected at the confluent portion of the exhaust system is the same as a problem with an ordinary Kalman filter used in observing x(k) by the following state equation and output equation (6A), (6B). If weight matrices Q, R are expressed by the following formula (7), the Riccati's equation can be solved to obtain a gain matrix K represented by the following formula (8):

$$X(k+1)=AX(k)+Bu(k) \tag{6A}$$

$$y(k)=CX(k)+Du(k) \tag{6B}$$

where $$A = \begin{bmatrix} 0100 \\ 0010 \\ 0001 \\ 1000 \end{bmatrix} \quad C = [C_1 C_2 C_3 C_4] \quad B = D = [0] \tag{7}$$

$$X(k) = \begin{bmatrix} x(k-3) \\ x(k-2) \\ x(k-1) \\ x(k) \end{bmatrix}$$

$$Q = \begin{bmatrix} 1000 \\ 0100 \\ 0010 \\ 0001 \end{bmatrix} \quad R = [1]$$

-continued $$K = \begin{bmatrix} -0.3093 \\ 1.1916 \\ 0.3093 \\ 0.0803 \end{bmatrix} \tag{8}$$

Figure 6:
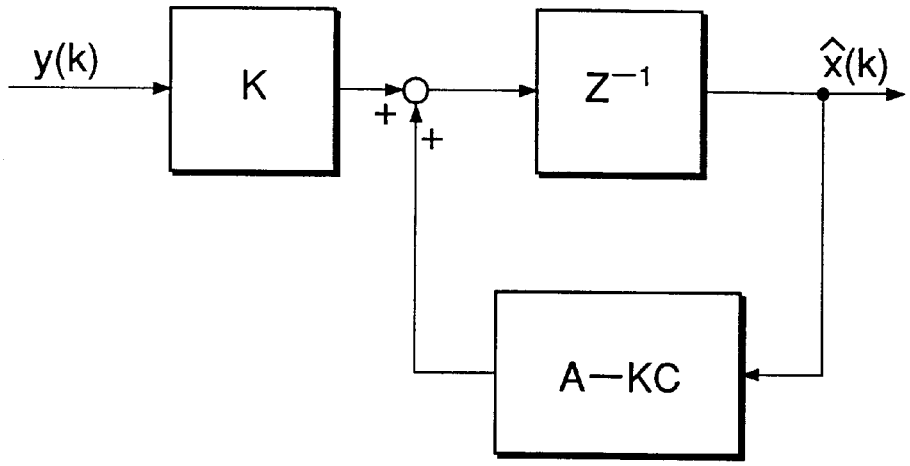
FIG. 6 is a block diagram showing the construction of an observer according to the embodiment.

In the present embodiment, there is no inputting of u(k) which is input to an observer of a general type, so that the observer is constructed such that y(k) alone is input thereto as shown in FIG. 6, which is expressed by the following formula (9).

$$\hat{X}(k+1) = [A - KC]\hat{X}(k) + Ky(k) \tag{9}$$

$$\left( = A\hat{X}(k) + K\left(y(k) - C\hat{X}(k)\right)\right)$$

$$\hat{X}(k) = [0001] \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value $\hat{X}(k)$ of the cylinder-by-cylinder fuel-air ratio obtained in the past, the estimated value $\hat{X}(k)$ of the same in the present loop can be calculated.

When the estimated value $\hat{X}(k+l)$ of the cylinder-by-cylinder fuel-air ratio is calculated by the use of the above formula (9), the actual equivalent ratio KACT(k) is used as the fuel-air ratio y(k) at the confluent portion. This actual equivalent ratio KACT(k) contains the delay of response of the LAF sensor, whereas $C\hat{X}(k)$ (i.e. the sum of the four cylinder-by-cylinder fuel-air ratio values multiplied by respective weights) does not contain the same. Therefore, the formula (9) which depends on the delay of response of the LAF sensor cannot enable an accurate estimation of the cylinder-by-cylinder fuel-air ratio. More particularly, when the engine rotational speed is high, the interval of generation of each TDC signal pulse becomes shortened accordingly, so that the delay of response of the LAF sensor has an increasing influence on the estimation of the cylinder-by-cylinder fuel-air ratio.

Therefore, in the present embodiment, an estimated value $\hat{y}(k)$ of the fuel-air ratio at the confluent portion of the engine is calculated first by the use of the following equation (10), and then by applying the estimated value $\hat{y}(k)$ to the following formula (11), the estimated value $\hat{X}(k+1)$ of the cylinder-by-cylinder fuel-air ratio is calculated.

$$\hat{y}(k+1)=DL\hat{y}(k-1)+(1-DL)C\hat{X}(k) \tag{10}$$

$$\hat{X}(k+1)=A\hat{X}(k)+K(y(k)-\hat{y}(k)) \tag{11}$$

Figure 7:
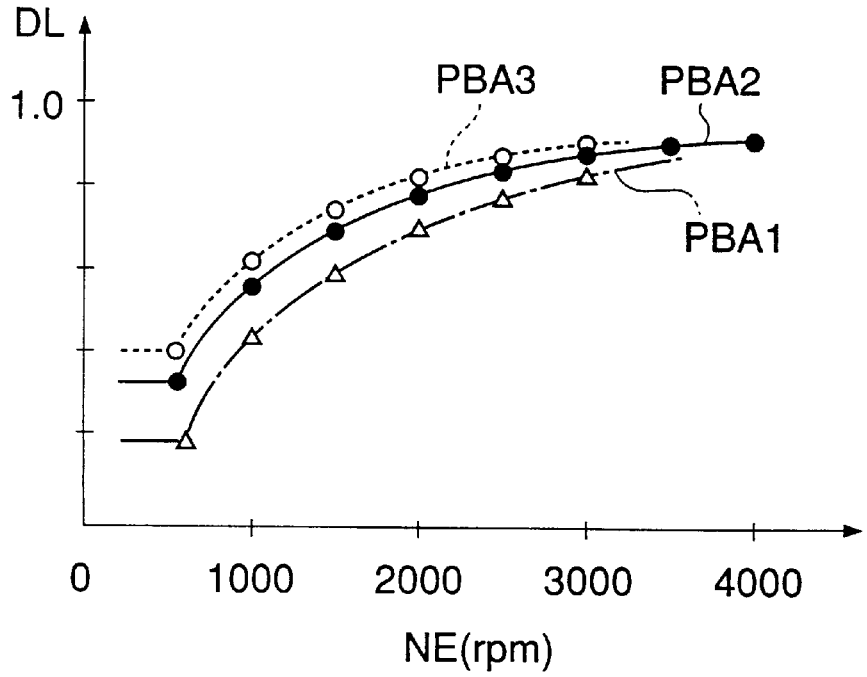
FIG. 7 is a diagram showing a table for setting a delay time constant representative of a delay time of response of the LAF sensor.

In the above equation (10), DL is a parameter indicative of a delay time constant representative of a response delay of the LAF sensor 17. In the present embodiment, DL is calculated by the use of a DL table shown in FIG. 7. The DL table has DL values in the range of 0 to 1.0 set according to the engine rotational speed NE and the intake pipe absolute pressure PBA. In the FIG. 7, PBA1 to PBA3 represent 660 mmHg, 460 mmHg and 260 mmHg, respectively. The delay time constant DL is determined by retrieving the DL table according to the detected engine rotational speed NE and the detected intake pipe absolute pressure PBA, and additionally by interpolation, if required. It was experimentally ascertained that the optimum value of the delay time constant DL is obtained when it is equivalent to a value approximately 20% longer than the actual delay time.

Further, in the equations (10) and (11), an initial vector of X(k) has, for instance, all the components thereof (x(k−3), x(k−2), x(k−1), x(k)) set to "1.0", and in the equation (10), an initial value of y(k−1) is set to "1.0".

In this way, by the use of the formula (11), wherein the CX(k) of the formula (9) is replaced by the estimated value y(k) of the fuel-air ratio at the confluent portion, which contains the response delay of the LAF sensor, the response delay of the LAF sensor can be appropriately compensated for, and the cylinder-by-cylinder air-fuel ratio can be accurately estimated. It should be noted that, in the following description, the estimated cylinder-by-cylinder equivalent ratios KACT#1(k) to KACT#4(k) correspond to x(k).

Figure 8:
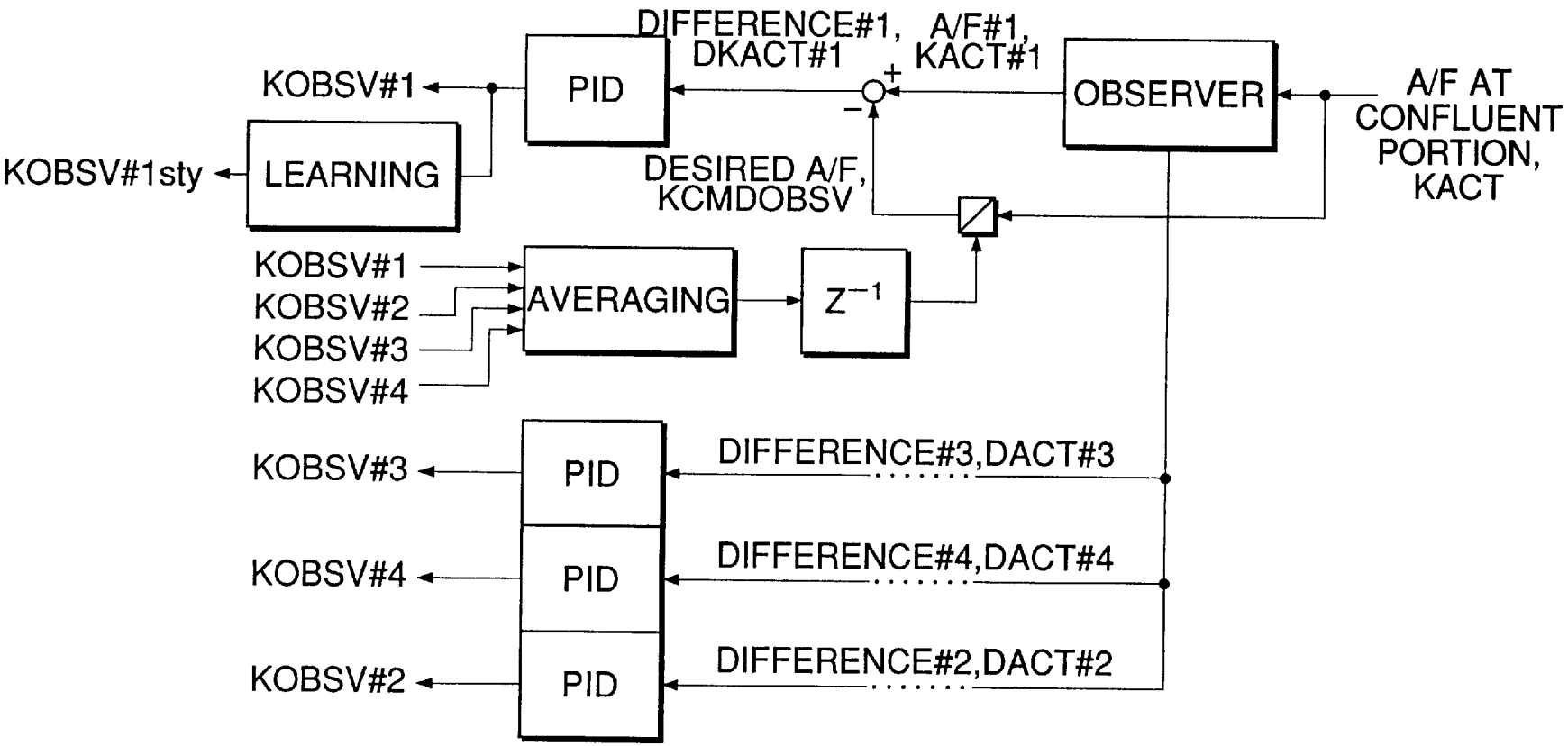
FIG. 8 is a block diagram which is useful in explaining how the air-fuel ratio feedback control is carried out cylinder by cylinder.

Next, a manner of calculating the cylinder-by-cylinder correction coefficient KOBSV#N based on the estimated cylinder-by-cylinder air-fuel ratio will be described with reference to FIG. 8.

First, as shown in the equation (12), a desired value KCMDOBSV(k) as an equivalent ratio corresponding to the desired air-fuel ratio A/F is calculated by dividing the actual equivalent ratio KACT corresponding to the air-fuel ratio A/F at the confluent portion by the immediately preceding value of the average value of the cylinder-by-cylinder correction coefficient KOBSV#N for all the cylinders. The cylinder-by-cylinder correction coefficient KOBSV#1 for the #1 cylinder is calculated by the PID control such that the difference DKACT#1(k) (=KACT#1(k)−KCMDOBSV(k)) between the desired value KCMDOBSV(k) and the cylinder-by-cylinder equivalent ratio KACT#1 estimated for the #1 cylinder becomes equal to zero.

$$KCMDOBSV(k) = \frac{KACT(k)}{\sum_{N=1}^{4} KOBSV\#N(k-1)/4} \tag{12}$$

More specifically, a proportional term KOBSVP#1, an integral term KOBSVI#1, and a differential term KOBSVD#1 are calculated by the use of the following equations (13A), (13B), (13C). Then, the cylinder-by-cylinder correction coefficient KOBSV#1 estimated for the #1 cylinder is calculated by the use of the following equation (14).

$$KOBSVP\#1(k)=KPOBSV\times DKACT\#1(k) \tag{13A}$$

$$KOBSVI\#1(k)=KIOBSV\times DKACT\#1(k)+KOBSVI\#1(k-1) \tag{13B}$$

$$KOBSVD\#1(k)=KDOBSV\times(DKACT\#1(k)-DKACT\#1(k-1) \tag{13C}$$

$$KOBSV\#1(k)=KOBSVP\#1(k)+KOBSVI\#1(k)+KOBSVD\#1(k)+1.0 \tag{14}$$

where KPOBSV, KIOBSV, and KDOBSV represent a basic proportional term, a basic integral term, and a basic differential term, respectively.

Similar calculations are carried out for the other cylinders #2 to #4 to obtain cylinder-by-cylinder correction coefficient values KOBSV#2 to #4.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by th e use of the PID correction coefficient KLAF, the air-fuel ratio values of mixtures supplied to all the cylinders can be eventually converged to the desired air-fuel ratio.

Further, a learned value KOBSV#Nsty of the cylinder-by-cylinder correction coefficient KOBSV#N is calculated by the use of the following equation (15) and stored:

$$KOBSV\#Nsty=Csty\times KOBSV\#N+(1-Csty)\times KOBSV\#Nsty \tag{15}$$

where Csty represents a weighting coefficient, and KOBSV#Nsty on the right side of the equation the immediately preceding learned value.

Figure 9:
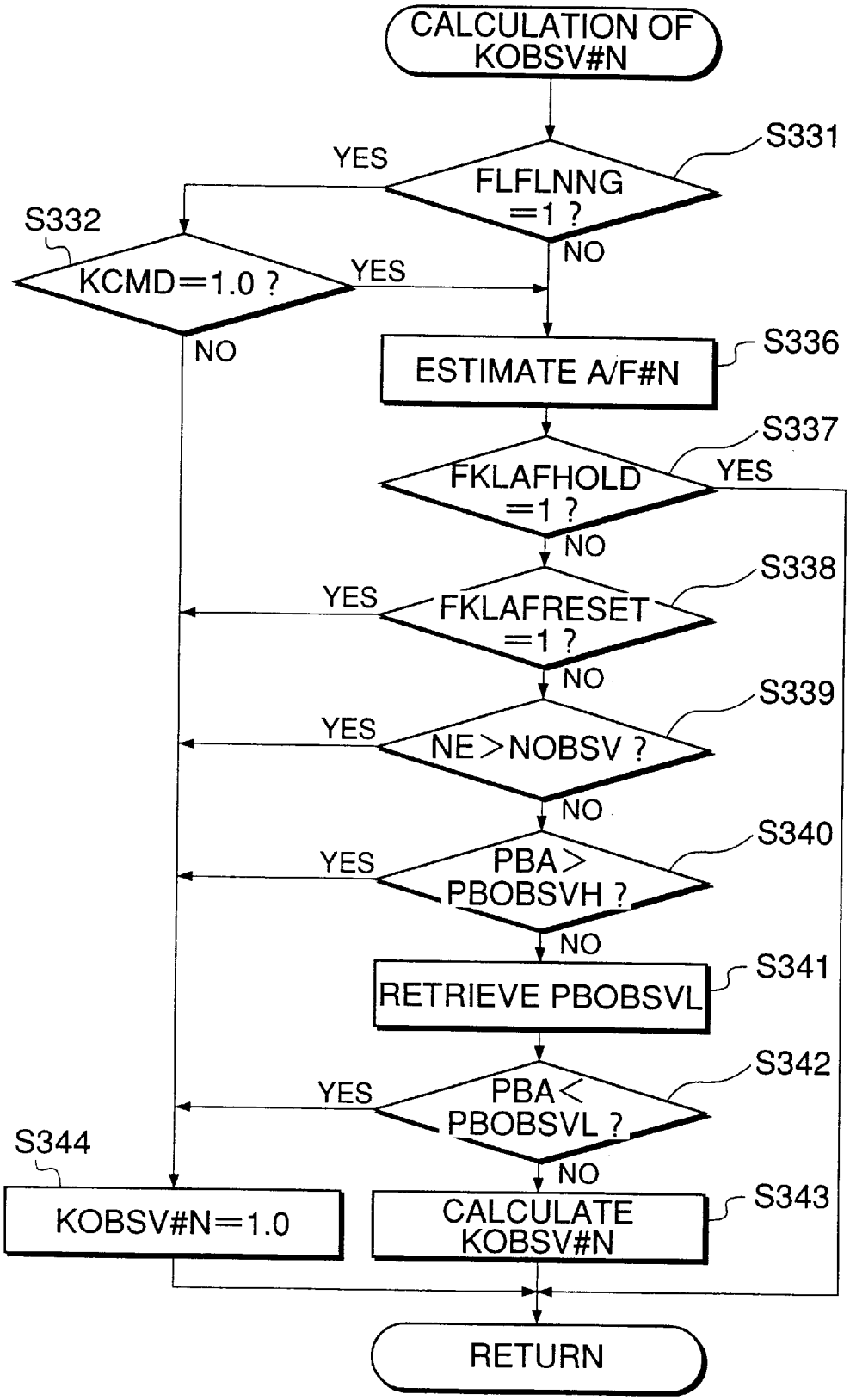
FIG. 9 is a flowchart showing a subroutine for calculating the cylinder-by-cylinder correction coefficient KOBSV#N, which is executed at a step S9 in FIG. 3.

FIG. 9 shows a subroutine for calculating the cylinder-by-cylinder correction coefficient KOBSV#N, which is executed at the step S9 in FIG. 3.

First, it is determined at a step S331 whether or not lean output deterioration of the LAF sensor 17 has been detected. If the lean output deterioration has not been detected, the program jumps to a step S336, whereas if the lean output deterioration has been detected, it is determined at a step S332 whether or not the desired air-fuel ratio XCMD is equal to 1.0, i.e. whether or not the desired air-fuel ratio is equal to the stoichiometric air-fuel ratio. The lean output deterioration of the LAF sensor means that the output from the LAF sensor exhibited when the air-fuel ratio of the mixture is actually controlled to a value leaner than the stoichiometric air-fuel ratio deviates from a proper value to a degree beyond a predetermined limit. If KCMD=1.0 holds at the step S332, the program proceeds to a step S336, whereas if KCMD≠1.0, the cylinder-by-cylinder correction coefficient KOBSV#N is set to 1.0 for all the cylinders at a step S344, followed by terminating the program without executing the cylinder-by-cylinder air-fuel ratio feedback control.

At the step S336, the air-fuel ratio is estimated cylinder by cylinder by the observer described above, and then it is determined at a step S337 whether or not a hold flag FKLAFHOLD, which, when set to "1", indicates that the PID correction coefficient should be held at the present value, assumes "1". If FYLAFHOLD=1 holds at the step S337, the present program is immediately terminated.

Figure 11:
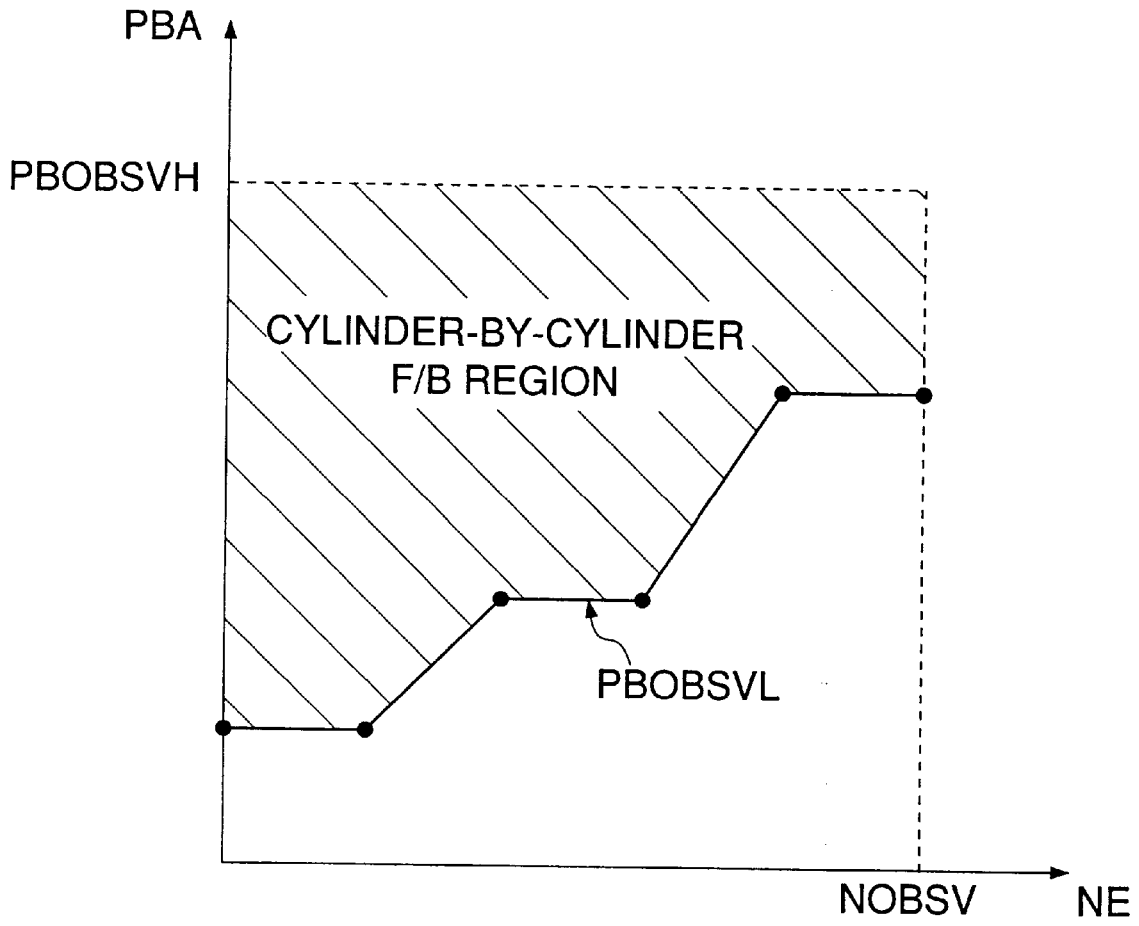
FIG. 11 is a diagram which is useful in explaining a cylinder-by-cylinder feedback control region.

If FKLAFHOLD=0 holds at the step S337, it is determined at a step S338 whether or not the reset flag FKLAFRESET assumes "1". If FKLAFRESET=0 holds, it is determined at a step S339 whether or not the engine rotational speed NE is higher than a predetermined value NOBSV (e.g. 3500 rpm). If NE≦NOBSV holds at the step S339, it is determined at a step S340 whether or not the intake pipe absolute pressure PBA is higher than a predetermined upper limit value PBOBSVH (e.g. 650 mmHg). If PBA≦PBOBSVH holds at the step S340, a PBOBSVL table shown in FIG. 11 is retrieved according to the engine rotational speed NE to determine a lower limit value PBOBSVL of the intake pipe absolute pressure at a step S341, and it is determined at a step S342 whether or not the intake pipe absolute pressure PBA is lower than the determined lower limit value PBOBSVL.

If any of the answers to the questions of the steps S338 to S340, and S342 is affirmative (YES), the program proceeds to the step S344, whereby the cylinder-by-cylinder air-fuel ratio feedback control is not carried out. On the other hand, if all the answers to the questions of the steps S338 to S340 and S342 are negative (NO), it is judged that the engine is in an operating region corresponding to a hatched area in FIG. 11, which means that the cylinder-by-cylinder air-fuel ratio feedback control can be carried out, so that the cylinder-by-cylinder correction coefficient KOBSV#N is calculated in the manner described above at a step S343, followed by terminating the program.

Figure 10:
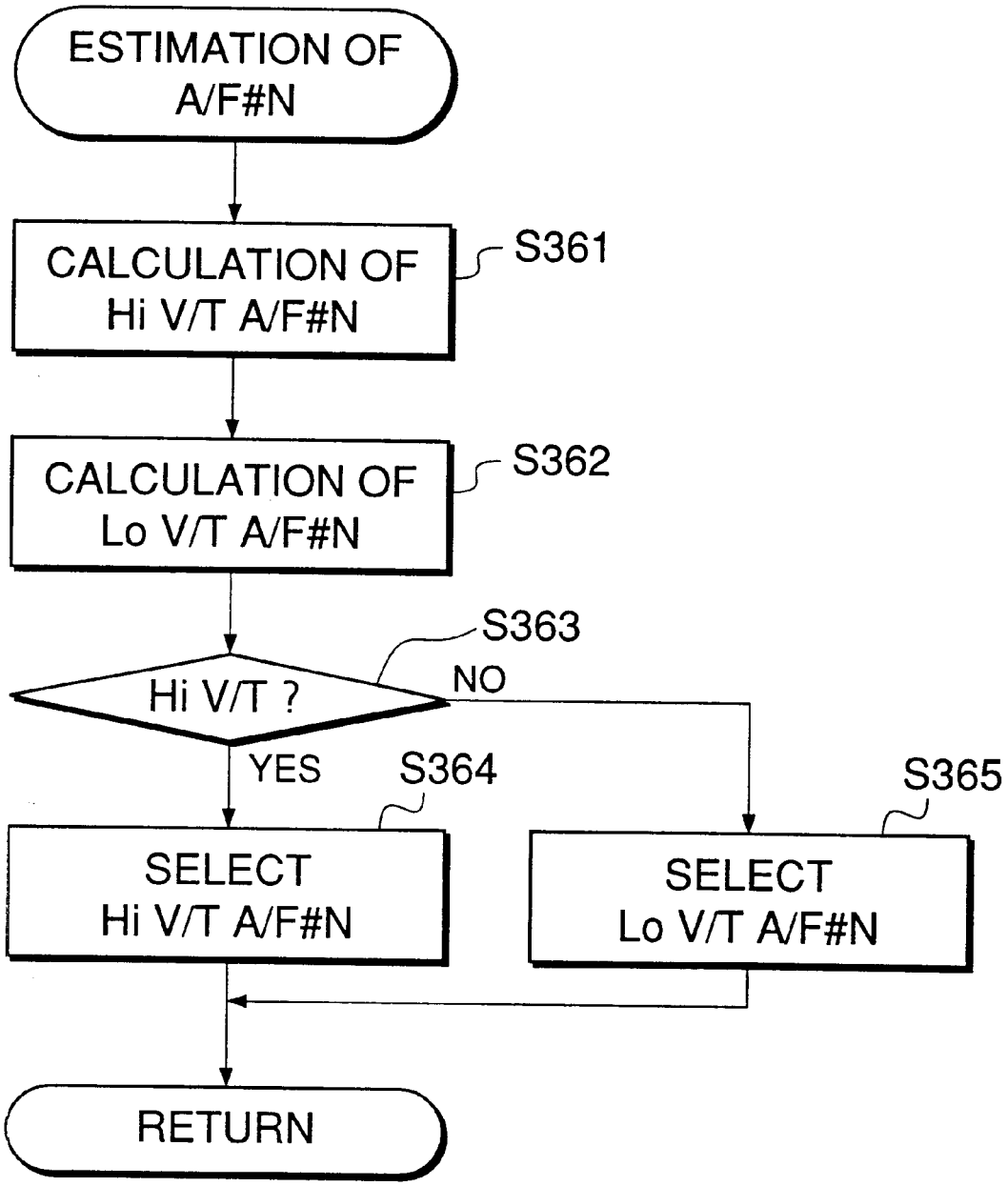
FIG. 10 is a flowchart showing a subroutine for estimating a cylinder-by-cylinder air-fuel ratio, which is executed at a step S336 in FIG. 9.

FIG. 10 shows a subroutine for estimating the cylinder-by-cylinder air-fuel ratio, which is executed at the step S336 in FIG. 9.

First, at a step S361, an arithmetic operation by the use of the observer (i.e. estimation of the cylinder-by-cylinder air-fuel ratio value) for the high-speed valve timing is carried out, and at the following step S362, an arithmetic calculation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Next, a subroutine for calculating the feedback correction coefficient KFB, which is executed at the step S10 in FIG. 3, will be described.

The feedback correction coefficient KFB is set to either the PID correction coefficient KLAF or the adaptive control correction coefficient KSTR according to operating conditions of the engine. First, manners of calculating these correction coefficients will be described with reference to FIGS. 12 and 13, respectively.

Figure 12:
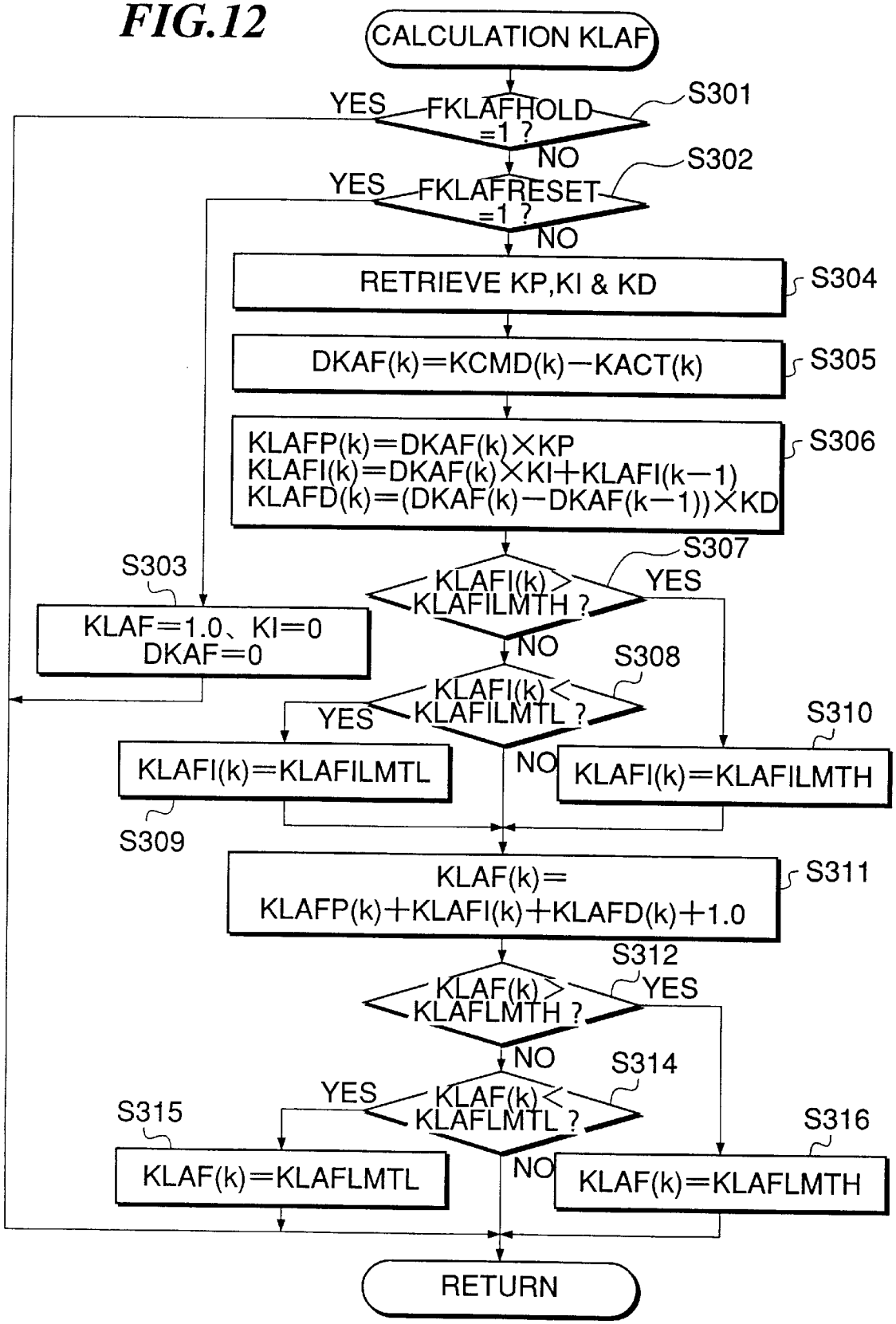
FIG. 12 is a flowchart showing a subroutine for calculating the PID correction coefficient KLAF, which is executed at a step S8 in FIG. 3.

FIG. 12 shows a routine for calculating the PID correction coefficient KLAF.

At a step S301 in FIG. 12, it is determined whether or not the hold flag FKLAFHOLD assumes "1". If FKLAFHOLD=1 holds, the present processing is immediately terminated, whereas if FKLAFHOLD=0 holds, it is determined at a step S302 whether or not the reset flag FKLAFRESET assumes "1". If FKLAFRESET=1 holds, the program proceeds to a step S303, wherein the PID correction coefficient KLAF is set to "1.0" and at the same time an integral term control gain KI and a difference DKAF between the desired equivalent ratio KCMD and the actual equivalent ratio KACT are set to "0", followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. It should be noted that during idling of the engine, gain values for the idling condition are adopted. Then, the difference DKAF (k) (=KCMD (k)−KACT (k)) between the desired equivalent ratio KCMD and the actual equivalent ratio KACT is calculated at a step S305, and the difference DKAF (k) and the gains KP, KI, and KD are applied to the following equations (16A) to (16C) to calculate a proportional term KLAFP (k), an integral term KLAFI (k), and a differential term KLAFD (k) at a step S306:

$$KLAFP(k)=DKAF(k)\times KP \tag{16A}$$

$$KLAFI(k)=DKAF(k)\times KI+KLAFI(k-1) \tag{16B}$$

$$KLAFD(k)=(DKAF(k)-DKAF(k-1))\times KD \tag{16C}$$

At the following steps S307 to S310, limit control of the integral term KLAFI (k) is carried out. More specifically, it is determined whether or not the KLAFI (k) value falls within a range defined by predetermined upper and lower limit values KLAFILMTH and KLAFILMTL at steps S307 and S308, respectively. If KLAFI (k)>KLAFILMTH holds, the integral term KLAFI (k) is set to the predetermined upper limit value KLAFILMTH at a step S310, whereas if KLAFI (k)<KLAFILMTL holds, the same is set to the predetermined lower limit value KLAFILMTH at a step S309.

At the following step S311, the PID correction coefficient KLAF (k) is calculated by the use of the following equation (17):

$$KLAF(k)=KLAFP(k)+KLAFI(k)+KLAFD(k)+1.0 \tag{17}$$

Then, it is determined at a step S312 whether or not the KLAF (k) value is larger than a predetermined upper limit value KLAFLMTH. If KLAF (k)>KLAFLMTH holds, the PID correction coefficient KLAF is set to the predetermined upper limit value KLAFLMTH at a step S316, followed by terminating the program.

If KLAF (k)≦KLAFLMTH holds at the step S312, it is determined at a step S314 whether or not the KLAF (k) value is smaller than a predetermined lower limit value KLAFLMTL. If KLAF (k)≧KLAFLMTL holds, the present program is immediately terminated, whereas if KLAF (k)<KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, description will be made of calculation of the adaptive control correction coefficient KSTR with reference to FIG. 13.

Figure 13:
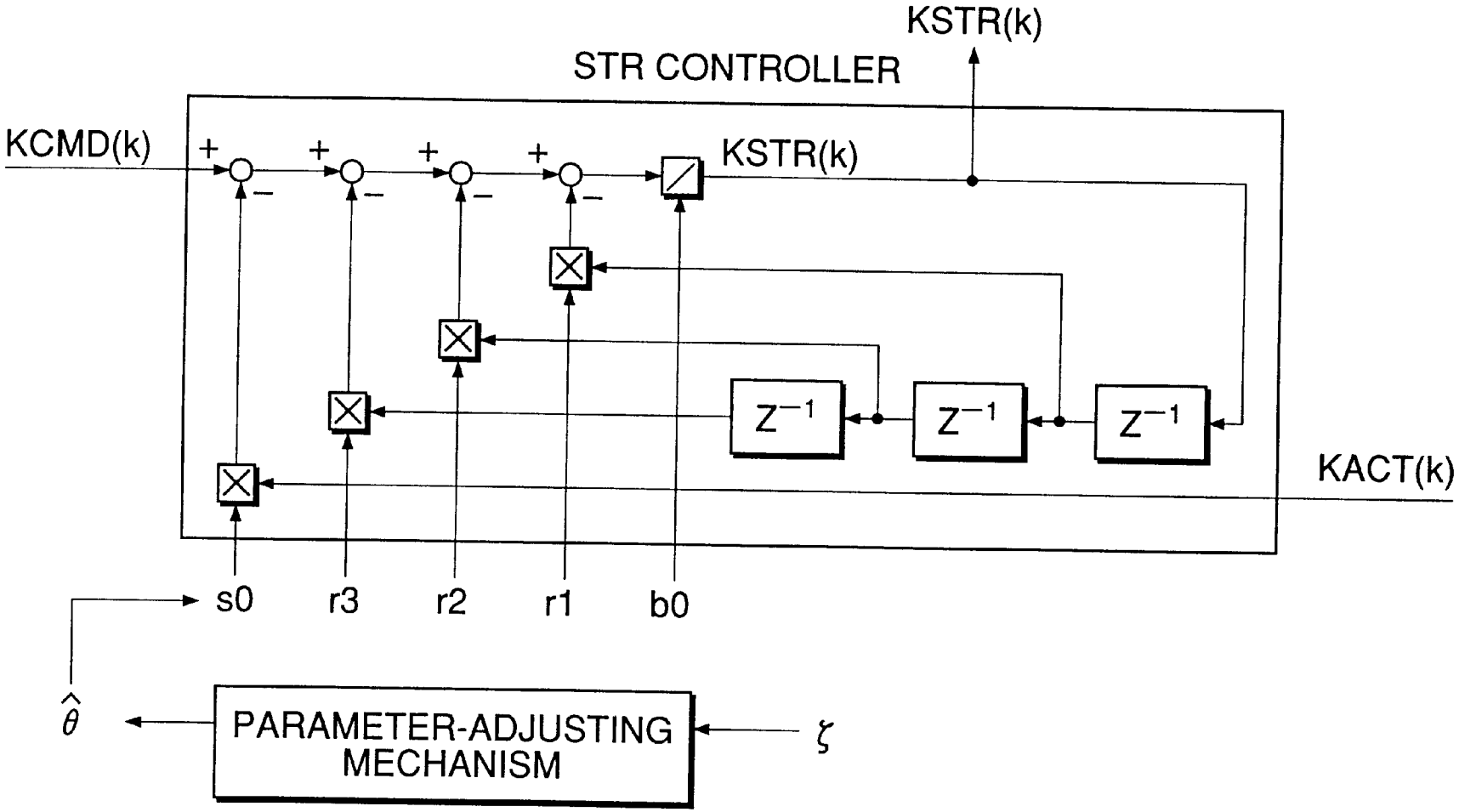
FIG. 13 is a block diagram which is useful in explaining a manner of calculating an adaptive control correction coefficient KSTR.

FIG. 13 shows the construction of the block B19 in FIG. 2, i.e. the self-tuning regulator (hereinafter referred to as "the STR") block. The STR block is comprised of a STR controller for setting the adaptive control correction coefficient KSTR such that the detected equivalent ratio KACT (k). becomes equal to the desired air-fuel ratio coefficient (desired equivalent ratio) KCMD (k), and a parameter-adjusting mechanism for setting parameters to be used by the STR controller.

Adjustment laws (mechanisms) for adaptive control employed in the present embodiment include a parameter adjustment law proposed by Landau et al. According to this parameter adjustment law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This law is known and described e.g. in "Computrole" No. 27, CORONA PUBLISHING CO., LTD., Japan, pp. 28–41, "Automatic Control Handbook" OHM, LTD., Japan, pp. 703–707, "A Survey of Model Reference Adaptive Techniques-Theory and Application", I. D. LANDAU "Automatica" Vol. 10, pp. 353–379, 1974, "Unification of Discrete Time Explicit Model Reference Adaptive Control Designs", I.D. LANDAU et al. "Automatica" Vol. 17, No. 4, pp. 593–611, 1981, and "Combining Model Reference Adaptive Controllers and Stochastic Self-tuning Regulators", I. D.LANDAU "Automatica" Vol. 18, No. 1, pp. 77–84, 1992.

In the present embodiment, the above parameter adjustment law proposed by Landau et al. is employed. This parameter adjustment law will be described in detail hereinbelow: According to this adjustment law, if polynomials of the denominator and numerator of the transfer function $A(Z^{-1})/B(Z^{-1})$ of the object of control by a discrete system are expressed by the following equations (18A) and (18B), the adaptive parameter $\hat{\theta}(k)$ and the input $\xi(k)$ to the adaptive parameter-adjusting mechanism are defined by the following equations (19) and (20). The equations (19) and (20) define an example of a plant in which m=1, n=1, and d=3 hold, i.e. a system of the first order thereof has an ineffective time as long as three control cycles. The symbol k used herein indicates that the parameter with (k) has the present value, one with (k−1) the immediately preceding value, and so forth. u(k) and y(k) correspond to the adaptive control correction coefficient KSTR(k) value and the estimated cylinder-by-cylinder equivalent ratio KACT#N(k) value, respectively, in the present embodiment.

$$A(z^{-1})=1+a_1z^{-1}+\ldots+a_nz^{-n} \tag{18A}$$

$$B(z^{-1})=b_0+bz^{-1}+\ldots+b_mz^{-m} \tag{18B}$$

$$\begin{aligned}\hat{\theta}^T(k) &= \left[\hat{b}_0(k), \hat{r}_1(k), \ldots r_{m+d-1}(k), S_0(k), \ldots, S_{n-1}(k)\right] \\ &= [b_0(k), r_1(k), r_2(k), r_3(k), s_0(k)]\end{aligned} \tag{19}$$

$$\begin{aligned}\zeta^T(k) &= [u(k), \ldots, u(k-m-d+1), y(k), \ldots, y(k-n+1)] \\ &= [u(k), u(k-1), u(k-2), u(k-3), y(k)]\end{aligned} \tag{20}$$

The adaptive parameter $\hat{\theta}(k)$ is expressed by the following equation (21):

$$\hat{\theta}(k)=\hat{\theta}(k-1)+\Gamma(k-1)\xi(k-d)e^*(k) \tag{21}$$

where the symbols $\Gamma(k)$ and $e^*(k)$ represent a gain matrix and an identification error signal, respectively, and can be expressed by the following recurrence formulas (22) and (23):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \tag{22}$$

$$e*(k) = \frac{D(z^{-1})y(k) - \hat{\theta}^T(k-1)\zeta(k-d)}{1+\zeta^T(k-d)\Gamma(k-1)\zeta(k-d)} \tag{23}$$

Further, it is possible to provide various specific algorithms depending upon set values of $\lambda1(k)$ and $\lambda2(k)$ of the equation (22). For example, if $\lambda1(k)=1$ and $\lambda2(k)=\lambda$ $(0<\lambda1<2)$, a progressively decreasing gain algorithm is provided (if $\lambda=1$, the least square method), if $\lambda1(k)=\lambda1$ $(0<\lambda1<1)$ and $\lambda2(k)=\lambda2(0<\lambda2<2)$, a variable gain algorithm (if $\lambda2=1$, the method of weighted least squares), and if $\lambda1(k)/\lambda2(k)=\sigma$ and if $\lambda3$ is expressed by the following equation (24), $\lambda1(k)=\lambda3$ provides a fixed trace algorithm. Further, if $\lambda1(k)=1$ and $\lambda2(k)=0$, a fixed gain algorithm is obtained. In this case, as is clear from the equation (23), $\Gamma(k)=\Gamma(k-1)$, and hence $\Gamma(k)=\Gamma$(fixed value) is obtained.

$$\lambda_3(k) = 1 - \frac{\|\Gamma(k-1)\zeta(k-d)\|^2}{\sigma+\zeta^T(k-d)\Gamma(k-1)\zeta(k-d)}\cdot\frac{1}{tr\Gamma(0)} \tag{24}$$

In the example of FIG. 13, the STR controller (adaptive controller) and the adaptive parameter-adjusting mechanism are arranged outside the fuel injection amount-calculating system, and operate to calculate the feedback correction coefficient KSTR (k) such that the actual air-fuel ratio KACT (k) becomes equal to the desired air-fuel ratio coefficient KCMD (k−d') (d' represents the above-mentioned ineffective time period before the KCMD value reflects on the actual air-fuel ratio KACT) in an adaptive manner.

In this manner, the adaptive control correction coefficient KSTR (k) and the estimated cylinder-by-cylinder equivalent ratio KACT#N(k) are determined, which are input to the adaptive parameter-adjusting mechanism, where the adaptive parameter $\hat{\theta}(k)$ is calculated to be input to the STR controller. The STR controller is also supplied with the desired equivalent ratio coefficient KCMD (k) and calculates the adaptive control correction coefficient KSTR (k) such that the actual equivalent ratio KACT (k) becomes equal to the desired equivalent ratio coefficient KCMD (k), by the use of the following recurrence formula (25):

$$KSTR(k)=\{KCMD(k-d')-s_0\times KACT(k)-r_1\times KSTR(k-1)-r_2\times KSTR(k-2)-r_3\times KSTR(k-3)\}/b_0 \tag{25}$$

In the above description, the control cycle and the repetition period of calculation of the KSTR value (repetition period of generation of TDC signal pulses) are made coincident to each other, and the adaptive control correction coefficient KSTR thus calculated is commonly used for all the cylinders. The present embodiment, however, employs the control cycle made corresponding to the number of cylinders or four TDC signal pulses, whereby the adaptive control correction coefficient KSTR is determined cylinder by cylinder. More specifically, the above-mentioned formulas (20) to (25) are replaced by the following formulas (26) to (31), respectively, to determine the adaptive control correction coefficient KSTR cylinder by cylinder for use in the adaptive control.

$$\xi^T(k)=[u(k),u(k-4),u(k-8),u(k-12),y(k)] \tag{26}$$

$$\hat{\theta}(k)=\hat{\theta}(k-4)+\Gamma(k-4)\xi(k-4\times d)e^*(k) \tag{27}$$

$$\Gamma(k) = \frac{1}{\lambda_1(k)}\left[\Gamma(k-1) - \frac{\lambda_2(k)\Gamma(k-4)\zeta(k-4\times d)\zeta^T(k-4\times d)\Gamma(k-4)}{\lambda_1(k)+\lambda_2(k)\zeta^T(k-4\times d)\Gamma(k-4)\zeta(k-4\times d)}\right] \tag{28}$$

$$e*(k) = \frac{D(z^{-1})y(k) - \hat{\theta}^T(k-4)\zeta(k-4\times d)}{1+\zeta^T(k-4\times d)\Gamma(k-4)\zeta(k-4\times d)} \tag{29}$$

$$\lambda_3(k) = 1 - \frac{\|\Gamma(k-4)\zeta(k-4\times d)\|^2}{\sigma+\zeta^T(k-4\times d)\Gamma(k-4)\zeta(k-4\times d)}\cdot\frac{1}{tr\Gamma(0)} \tag{30}$$

$$KSTR(k)=\{KCMD(k-4\times d')-s_0\times KACT(k)-r_1\times KSTR(k-4)-r_2\times KSTR(k-8)-r_3\times KSTR(k-12)\}/b_0 \tag{31}$$

d in the above formula (31) represents e.g. "2".

As described above, in the present embodiment, the adaptive control correction coefficient KSTR is calculated cylinder by cylinder and at the same time y(k) to be input to the adaptive parameter-adjusting mechanism is set not to the actual equivalent ratio KACT(k) value but to the estimated cylinder-by-cylinder equivalent ratio KACT#N(k) value, which makes it possible to reflect the variations in the characteristics between the cylinders appropriately in the adaptive parameter and hence improve the controllability of the air-fuel ratio.

Next, a manner of calculation of the feedback correction coefficient KFB by switching between the PID correction coefficient KLAF and the adaptive control correction coefficient KSTR, i.e. by switching between the PID control and the adaptive control, will be described.

Figure 14:
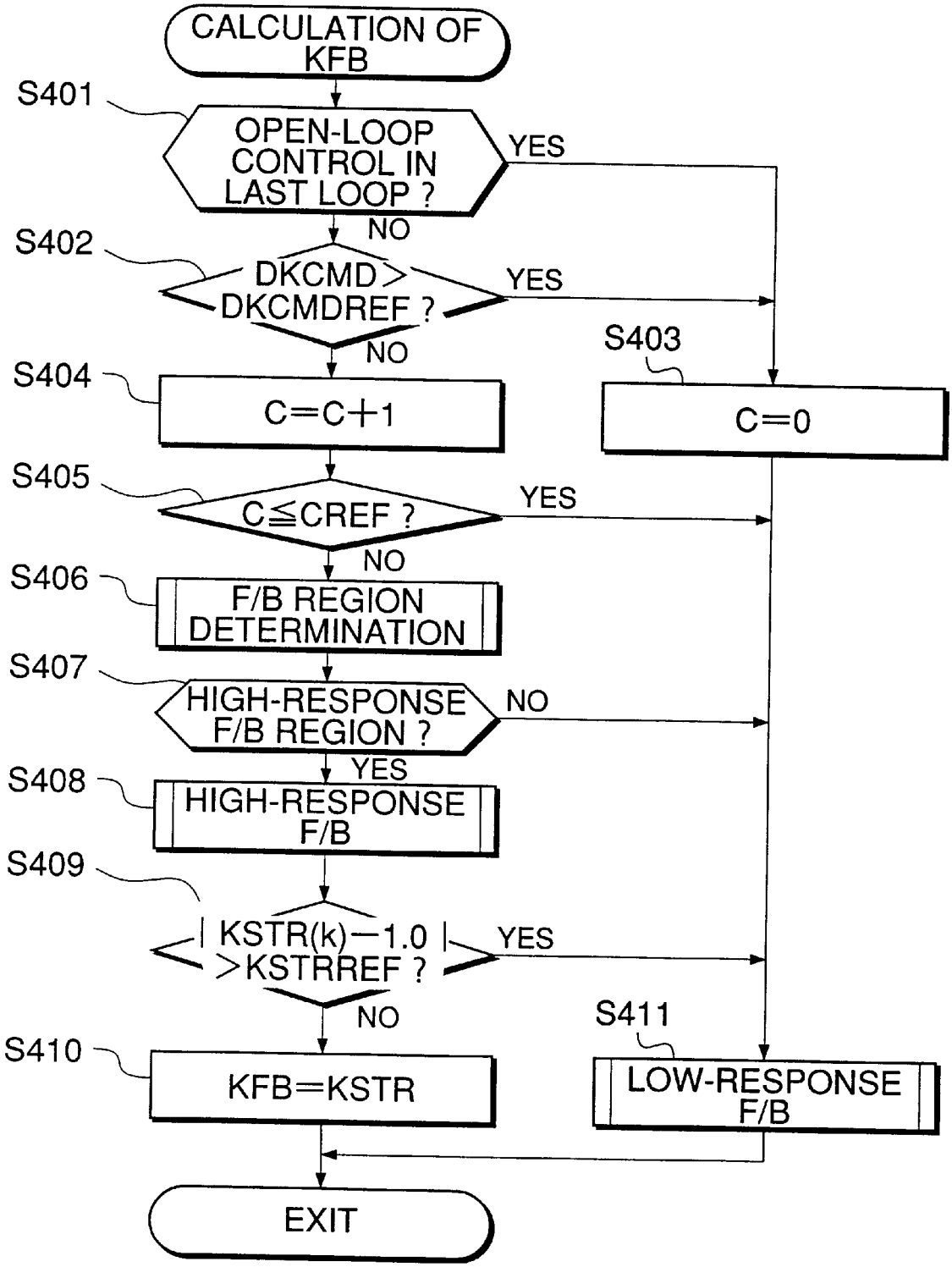
FIG. 14 is a flowchart showing a subroutine for calculating a feedback correction coefficient KFB, which is executed at a step S10 in FIG. 3.

FIG. 14 shows a subroutine for calculating the feedback correction coefficient KFB, which is executed at the step S10 in FIG. 3.

First, it is determined at a step S401 whether or not the control mode was an open-loop control mode in the last loop of execution of the FIG. 3 routine, i.e. whether or not FKLAFRESET=1 held. If the control mode was not the open-loop control mode, it is determined at a step S402 whether or not a rate of variation DKCMD in the desired equivalent ratio KCMD (=| KCMD (k)−KCMD (k−1) |) is larger than a reference value DKCMDREF. If the control mode was the open-loop control mode in the last loop of execution of the FIG. 3 routine, or if the control mode was the feedback control mode in the last loop of execution of the FIG. 3 routine and at the same time the rate of variation DKCMD is larger than the reference value DKCMDREF, it is judged that the engine is in a region where a low-response feedback control should be executed (hereinafter referred to as "the low-response F/B region"). Then, a counter C is reset to "0" at a step S403, followed by the program proceeding to a step S411. At the step S411, the low-response F/B control is executed, which will be described hereinafter with reference to FIG. 18, followed by terminating the program.

As noted above, the engine is determined to be in the low-response F/B region when the engine was in the open-loop region in the last loop because an air-fuel ratio value indicated by the LAF sensor output does not necessarily show a true or exact value of the air-fuel ratio due to a delay of detection by the LAF sensor, which will occur e.g. when the fuel supply is resumed after fuel cut, so that the air-fuel ratio feedback control can be unstable. For a similar reason, when the amount of change DKCMD in the desired equivalent ratio KCMD is large, which will occur e.g. when a WOT enriching operation is stopped to resume the normal air-fuel control, or when the air-fuel ratio control is switched over from the lean-burn control to the feedback control to the stoichiometric air-fuel ratio, the engine is determined to be in the low-response F/B region.

If the answers to the questions of the steps S401 and S402 are both negative (NO), i.e. if the control mode was the feedback control mode in the last loop and at the same time the rate of variation DKCMD
in the desired equivalent ratio KCMD is equal to or smaller than the reference value DKCMDREF, the count of the counter C is incremented by "1" at a step S404, and then the count of the counter C is compared with a predetermined value CREF (e.g. 5) at a step S405. If C≦CREF holds, the program proceeds to the step S411, whereas if C>CREF holds, the program proceeds to a step S406, wherein it is determined by executing a subroutine, described hereinafter, whether the engine is operating in a region in which a high-response feedback control should be executed (hereinafter referred to as "high-response F/B region") or in the low-response F/B region. Then, at a step S407, it is determined whether or not the control region in which the engine has been determined to be operating at the step S406 is the high-response F/B region. If the determined control region is not the high-response F/B region, the program proceeds to the step S411, whereas if the control region is the high-response F/B region, the program proceeds to a step S408, wherein a subroutine for the high-response feedback control, described hereinafter, is executed to calculate the adaptive control correction coefficient KSTR. Then, it is determined at a step S409 whether or not the absolute value of the difference | KSTR(k)−1.0 | between the adaptive control correction coefficient KSTR and 1.0 is larger than a predetermined reference value KSTRREF. If | KSTR (k)−1.0 |>KSTRREF holds, the program proceeds to the step S411, whereas if | KSTR (k)−1.0 |≦KSTRREF holds, the feedback correction coefficient KFB is set to the KSTR value at a step S410, followed by terminating the program.

When the absolute value of the difference between the adaptive control correction coefficient KSTR and 1.0 is larger than the predetermined reference value KSTRREF, the low-response feedback control is thus selected for the purpose of achieving stability of the control.

When the count of the counter C is smaller than the reference value CREF, the low-response feedback control is thus selected because immediately after returning of the engine operating condition from the open-loop control or immediately after a large variation in the desired equivalent ratio KCMD, a time lag before completion of the fuel combustion and a response lag of the LAF sensor are so large that influences thereof cannot be compensated for by the adaptive control.

Figure 15:
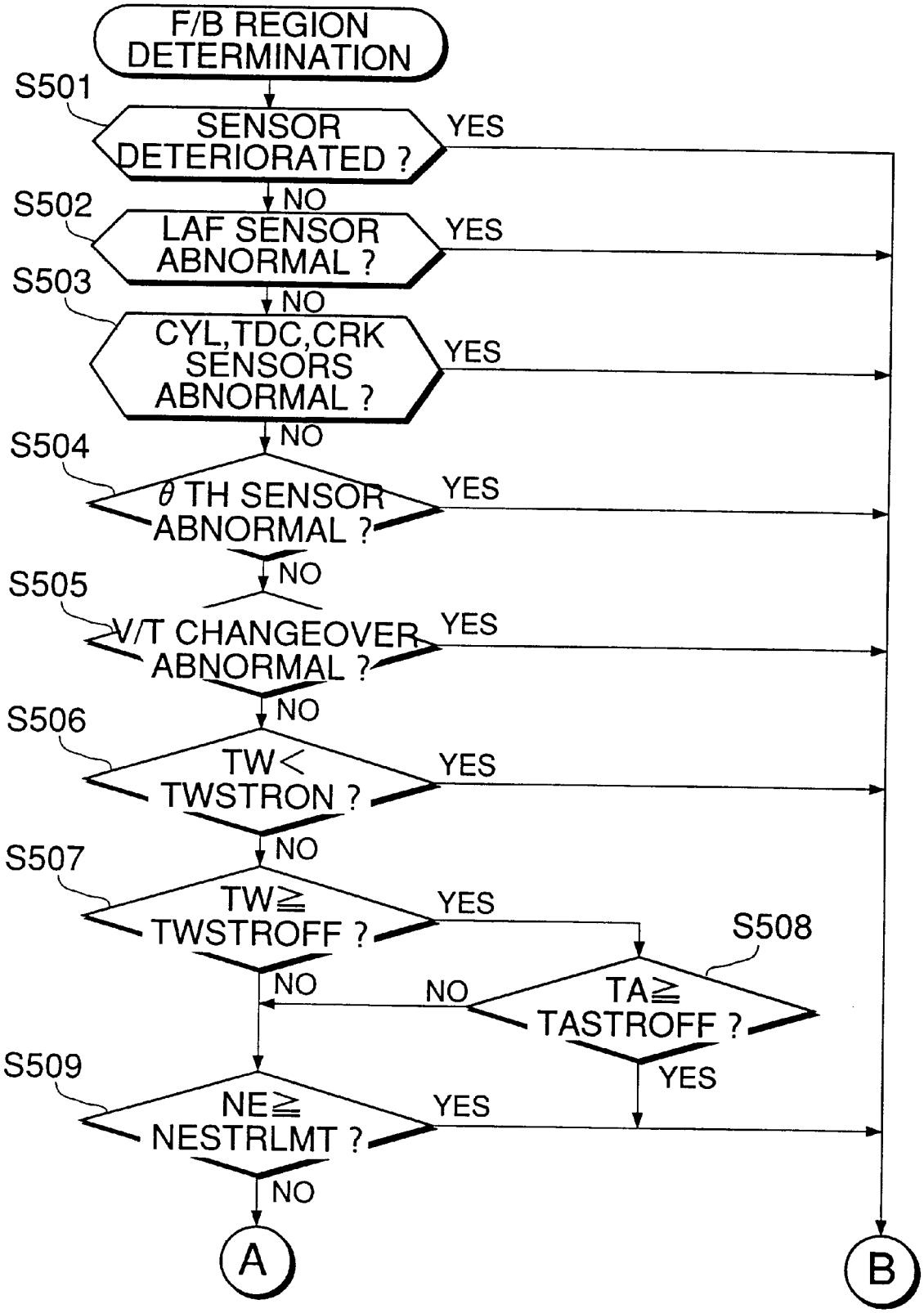
FIG. 15 is a flowchart showing a subroutine for selecting the response speed of the air-fuel ratio feedback control, which is executed at a step S406 in FIG. 14.
Figure 16:
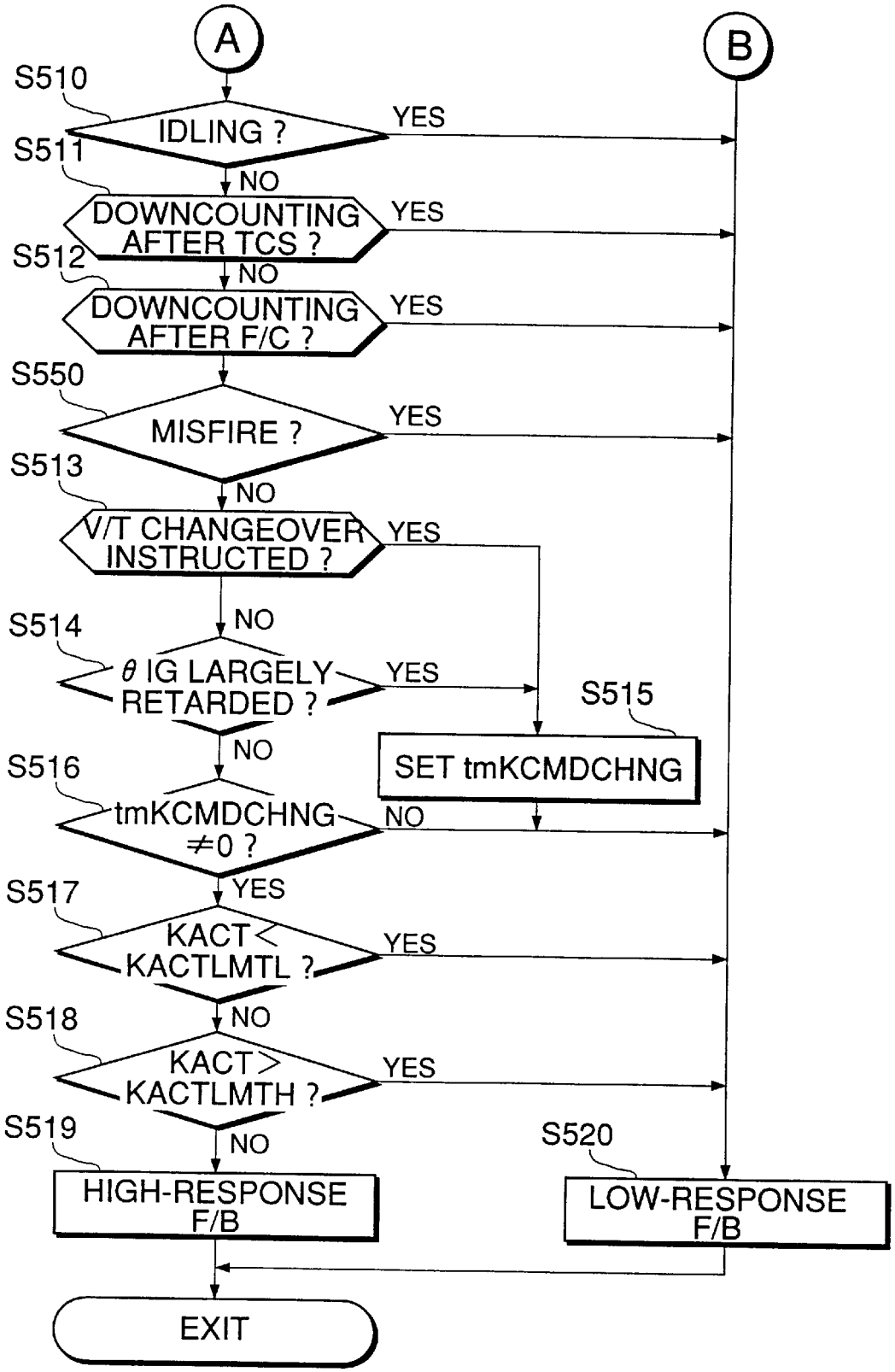
FIG. 16 is a continued part of the FIG. 15 flowchart.

Next, the subroutine executed at the step S406 in FIG. 14 for selecting the response speed of the air-fuel ratio feedback control, i.e. determining whether the engine is operating in the high-response F/B region or in the low-response F/B region will be described with reference to FIGS. 15 and 16.

First, at a step S501, it is determined whether or not the LAF sensor 17 is deteriorated in response characteristic. If the LAF sensor 17 is not deteriorated in response characteristic, the program proceeds to a step S502.

At the step S502, it is determined whether or not abnormality of the LAF sensor 17 has been detected. If no abnormality of the LAF sensor 17 has been detected, it is determined at a step S503 whether or not abnormality of the crank angle sensor 14 (cylinder-discriminating sensor, TDC sensor, CRK sensor) has been detected. If no abnormality of the crank angle sensor has been detected, it is determined at a step S504 whether or not abnormality of the throttle valve opening θTH sensor 4 has been detected. If no abnormality of the throttle valve opening sensor 4 has been detected, it is determined at a step S505 whether or not abnormality of the valve timing changeover mechanism 60 has been detected.

If all the answers to the questions of the steps S501 to S505 are negative (NO), the program proceeds to a step S506, whereas if any of the answers is affirmative (YES), it is determined at a step S520 that the engine is in the low-response F/B region, followed by terminating the program.

The low-response feedback control is thus selected when any of the above-mentioned sensors is abnormal, so as to prevent degradation of the controllability of the air-fuel ratio.

Then, at the step S506, it is determined whether or not the engine coolant temperature TW is lower than a predetermined value TWSTRON. If TW≧TWSTRON holds, it is determined at a step S507 whether or not the engine coolant temperature TW is equal to or higher than a predetermined value TWSTROFF (e.g. 100° C.). If TW≧TWSTROFF holds, it is determined at a step S508 whether or not the intake air temperature TA is equal to or higher than a predetermined value TASTROFF. If TW<TWSTROFF holds at the step S507 or if TW≧TWSTROFF holds at the step S507 and at the same time TA<TASTROFF holds at the step S508, the program proceeds to a step S509, wherein it is determined whether or not the engine rotational speed NE is equal to or higher than a predetermined value NESTRLMT. If NE<NESTRLMT holds, it is determined at a step S510 whether or not the engine is idling. If the engine is not idling, it is determined at a step S511 whether or not a timer is in operation for measuring a time period elapsed after termination of traction control by the traction control system (TCS). This timer is formed by a downcount timer, and set during TCS operation and started when the TCS operation is terminated.

If the timer is not in operation at the step S511, it is determined at a step S512 whether or not a timer is in operation for measuring a time period elapsed after termination of fuel cut. The fuel cut is carried out when the engine is in a predetermined decelerating condition, and the fuel cut flag FFC is set to "1" during the fuel cut operation. This timer is also formed by a downcount timer, and set during the fuel cut operation and started upon termination of fuel cut.

If any of the answers to the questions of the steps S506 and S509 to S512 is affirmative (YES), or if both the answers to the questions of the steps S507 and S508 are affirmative (YES), it is determined at the step S520 that the engine is in the low-response F/B region, followed by terminating the program. If the answer to the question of the step S512 is negative (NO), the program proceeds to a step S550.

At the step S550, it is determined whether or not a misfire has occurred in the engine. A misfire can be determined to have occurred in the engine when the variation of the engine rotational speed NE is above a predetermined value, as disclosed in Japanese Laid-Open Patent Publication (Kokai) No. 6-146998 filed by the present assignee. When the engine suffers from a misfire, the program proceeds to the step S520, whereas when the engine does not suffer from a misfire, the program proceeds to a step S513.

At the step S513, it is determined whether or not changeover of the valve timing between the high-speed V/T and the low-speed V/T has been instructed. If the changeover has not been instructed, it is determined at a step S514 whether or not the ignition timing of the engine has been largely retarded. If the ignition timing has not been largely retarded, the program proceeds to a step S516. If either the answer to the question of the step S513 or the answer to the question of the step S514 is affirmative (YES), a downcount timer tmKCMDCHNG is set to a predetermined time period TCHNG and started at a step S515, followed by the program proceeding to the step S520. The predetermined time period TCHNG is set to a time period sufficient for the combustion of the engine to become stable after the changeover of the valve timing has been instructed or after the ignition timing has been largely retarded.

At the step S516, it is determined whether or not the count of the downcount timer tmKCMDCHNG is not equal to "0". If the count is not equal to "0", the program proceeds to the step S520, whereas if the count is equal to "0", it is determined at steps S517 and S518 whether or not the actual equivalent ratio KACT is within a predetermined range defined by a predetermined lower limit value KACTLMTL (e.g. 0.99) and a predetermined upper limit value KACTLMTH (e.g. 1.01). If KACT<KACTLMTL or KACT>KACTLMTH holds, the program proceeds to the step S520, whereas if KACTLMTL≦KACT≦KACTLMTH holds, the program proceeds to a step S519, wherein it is determined that the engine is in the high-response F/B region, followed by terminating the program.

By executing the steps S517 and S518, changeover of the feedback control from the low-response feedback control to the high-response feedback control is carried out only when the actual equivalent ratio KACT is equal to 1.0 or a value close thereto, to thereby achieve smooth changeover of the feedback control mode and hence ensure required stability of the fuel-ratio control. The reason why it is thus determined by the steps S506 to S516 that the low-response feedback control should be executed is as follows:

When the engine coolant temperature TW is low (TW<TWSTRON), the engine combustion is not stable due to insufficient atomization of fuel and increased friction between the piston and the cylinder, so that a misfire can occur. Therefore, a stable value of the detected equivalent ratio KACT cannot be obtained if the high-response feedback control is carried out in such a condition. Also when the engine coolant temperature TW is extremely high (TW≧TWSTROFF) and at the same time the intake air temperature is extremely high (TA≧TASTROFF), vapor lock can occur in the fuel supply line to decrease the actual amount of fuel injection. When the engine rotational speed NE is high, i.e. if NE≧NESTRLMT holds, the ECU 5 can have an insufficient calculation time and further the engine combustion is not stable.

Further, when the engine is idling, the engine operating condition is almost stable such that the high-response feedback control, which has a high gain, is not required to be carried out. Immediately after termination of the traction control in which the ignition timing is temporarily largely retarded or fuel cut is effected to decrease the torque of the engine so as to avoid excessive slippage of the wheels, the engine combustion is not stable before a predetermined time period elapses after the termination of the traction control, so that execution of the high-response feedback control can unexpectedly result in an increase in the variation of the air-fuel ratio. For a similar reason, immediately after termination of a usual decelerating fuel cut operation, the low-response feedback control is selected. Similarly, when a misfire occurs in the engine, the engine combustion is undoubtedly unstable, so that the low-response feedback control is selected. Further, before a predetermined time period (TCHNG) elapses after changeover of the valve timing, the combustion state of the engine drastically changes due to a change in the valve opening period over which the intake or exhaust valves are opened. Also, before the predetermined time period TCHNG elapses after termination of control of ignition timing to a largely retarded timing, the engine combustion is not stable, and hence a stable KACT value cannot be expected.

In addition to the traction control, large retardation of the ignition timing may be carried out in execution of other kinds of control such as torque shock-reducing control executed when the automatic transmission undergoes a change in the shift gear position, knocking-avoiding control executed when load on the engine is high, ignition timing control executed for the purpose of accelerating the rise of the temperature of the catalysts immediately after the engine is started, or on like occasions.

Next, the high-response/low-response feedback control executed by the control system according to the present embodiment will be described.

Figure 17:
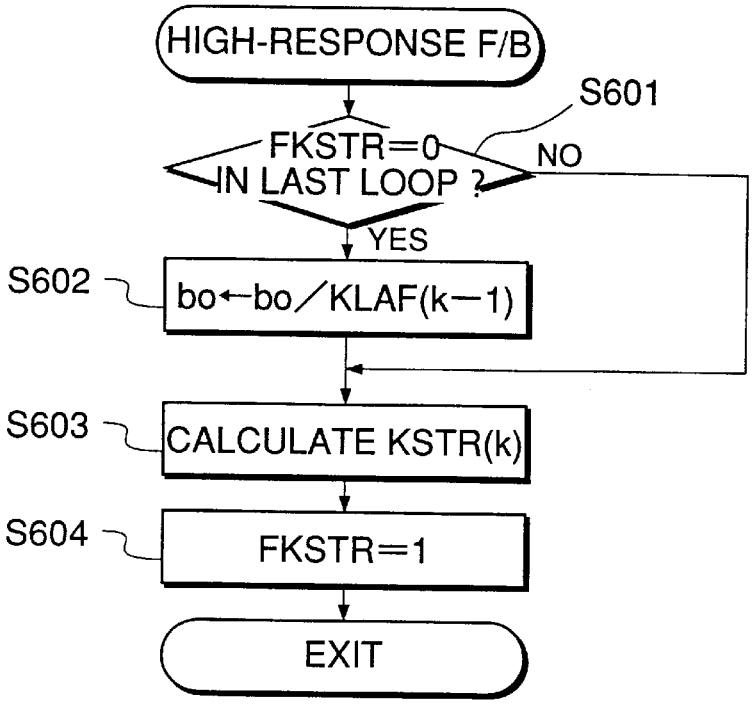
FIG. 17 is a flowchart showing a subroutine for carrying out a high response feedback control according to the present embodiment, which is executed at a step S408 in FIG. 14.

FIG. 17 shows a subroutine for carrying out the high-response feedback control executed at the step S408 in FIG. 14. First, at a step S601, it is determined whether or not a flag FKSTR, which, when set to "1", indicates that the engine is operating in a region in which the feedback control by the use of the adaptive control correction coefficient KSTR should be executed (hereinafter referred to as "the adaptive control region"), assumed "0" in the immediately preceding loop. If the flag KSTR assumed "1" in the last loop, the program jumps to a step S603, wherein the adaptive control correction coefficient KSTR is calculated in the manner described hereinbefore, and then the flag FKSTR is set to "1" at a step S604, followed by terminating the program.

On the other hand, if the flag FKSTR assumed "0" in the last loop, the adaptive parameter b0 (scalar quantity determining the gain) is replaced by a value obtained by dividing the b0 value by the last value KLAF (k−1) of the PID correction coefficient KLAF at a step S602, followed by the program proceeding to the step S603.

By replacing the adaptive parameter b0 by the value b0/KLAF(k−1) at the step S602, further smooth changeover from the PID control to the adaptive control can be obtained to thereby ensure required stability of the control. The reason for carrying out the replacement is as follows: If the value b0 in the equation (31) is replaced by the value b0/KLAF(k−1), the following equation (32) is obtained, where the first term of the first equation is equal to "1" because the adaptive control correction coefficient KSTR is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$\begin{aligned} KSTR(k) &= [\{KCMD(k-4\times d') - s_0\times KACT(k) - r_1\times KSTR(k-4) - \\ &\quad r_2\times KSTR(k-8) - r_3\times KSTR(k-12)\}/b_0]\times KLAF(k-1) \\ &= 1\times KLAF(k-1) \\ &= KLAF(k-1) \end{aligned} \tag{32}$$

Figure 18:
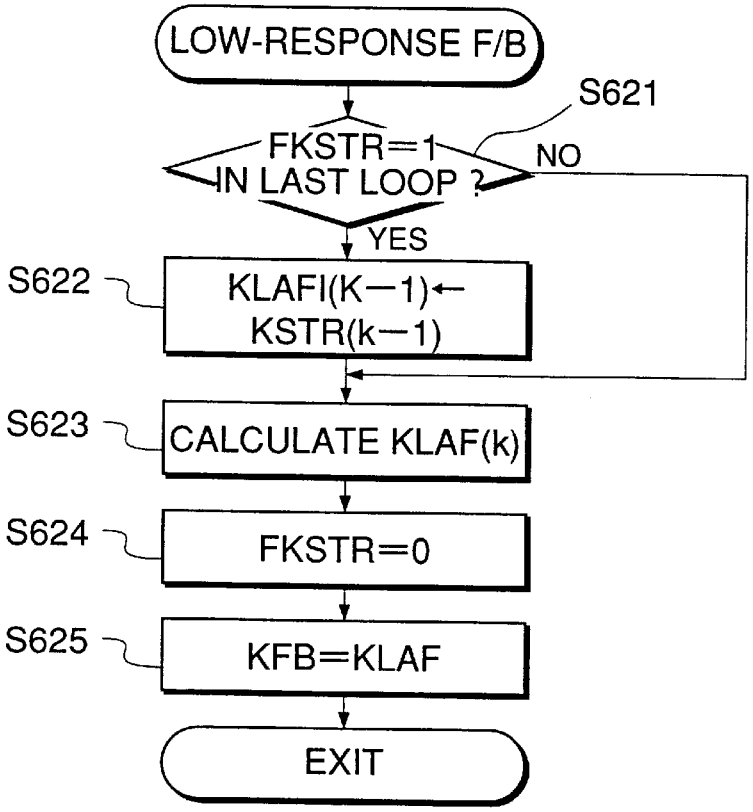
FIG. 18 is a flowchart showing a subroutine for carrying out a low-response feedback control according to the present embodiment, which is executed at a step S411 in FIG. 14.

FIG. 18 shows a subroutine for carrying out the low-response feedback control executed at the step S411 of the FIG. 14 subroutine. First, at a step S621, it is determined whether or not the STR flag FKSTR assumed "1" in the last loop. If FKSTR=0 held in the last loop, the program jumps to a step S623, wherein the PID correction coefficient KLAF is calculated by executing the FIG. 12 subroutine. Then, the flag FKSTR is set to "0" at a step S624, and the program proceeds to a step S625, wherein the feedback correction coefficient KFB is set to the PID correction coefficient KLAF (k) calculated at the step S623, followed by terminating the present program.

On the other hand, if FKSTR=1 held in the last loop, the immediately preceding value KLAFI (k−1) of the integral term of the PID control is set to the immediately preceding value KSTR (k−1) of the adaptive control correction coefficient KSTR at a step S622, followed by the program proceeding to the step S623.

When changeover from the adaptive control to the PID control is carried out (if FKSTR=1 held in the immediately preceding loop and the engine is in the low-response F/B region in the present loop), there is a possibility of a drastic change in the integral term KLAFI of the PID control. Therefore, the step S622 is executed to set KLAF (k−1)= KSTR (k−1). This can reduce the difference between the adaptive control correction coefficient KSTR (k−1) and the PID correction coefficient KLAF (k), whereby smooth changeover from the adaptive control to the PID control can be carried out, to thereby ensure required stability of the engine control.

By virtue of the operations carried out by the FIGS. 14 to 18 subroutines, so long as the engine combustion is not in a steady condition, the air-fuel ratio feedback control is changed over from the adaptive control to the PID control, whereby sufficient accuracy and stability of the air-fuel ratio control can be ensured even when the engine is not in a steady operating condition, to thereby maintain excellent driveability and exhaust emission characteristics of the engine.

It should be noted that in the present embodiment the STR is employed as an example of the adaptive controller of the recurrence formula type, but it is possible to employ a model reference adaptive control system (MRACS) instead of the STR.

What is claimed is:

1. In an air-fuel ratio control system for an internal combustion engine having a plurality of cylinders, and an exhaust system, the air-fuel ratio control system including:

air-fuel ratio-detecting means arranged in said exhaust system, for detecting an air-fuel ratio of exhaust gases emitted from said cylinders;

cylinder-by-cylinder air-fuel ratio-estimating means for estimating an air-fuel ratio of a mixture supplied to each of said cylinders, based on an output from said air-fuel ratio-detecting means by using observing means for observing an internal operative state of said exhaust system by means of a model representative of a behavior of said exhaust system; and feedback control means for carrying out feedback control of an amount of fuel to be supplied to said each of said cylinders in response to said output from said air-fuel ratio-detecting means by using a controller of a recurrence formula type, such that said air-fuel ratio of said mixture supplied to said each of said cylinders is converged to a desired value, the improvement wherein:

said controller of said recurrence formula type has parameter-adjusting means for adjusting adaptive parameters for use in said feedback control, said parameter-adjusting means adjusting said adaptive parameters for said each of said cylinders, based on said air-fuel ratio estimated by said cylinder-by-cylinder air-fuel ratio-estimating means.

2. An air-fuel ratio control system according to claim 1, wherein said controller of said recurrence formula type calculates an adaptive correction coefficient as a control amount of said feedback control of said air-fuel ratio, for said each of said cylinders, in response to said air-fuel ratio estimated by said cylinder-by-cylinder air-fuel ratio-estimating means, said parameter-adjusting means adjusting said adaptive parameters for said each of said cylinders, based on said air-fuel ratio estimated by said cylinder-by-cylinder air-fuel ratio-estimating means and said adaptive correction coefficient calculated for said each of said cylinders by said controller and corresponding to said air-fuel ratio estimated by said cylinder-by-cylinder air-fuel ratio-estimating means.

3. An air-fuel ratio control system according to claim 3, wherein said feedback control means calculates said desired value of said air-fuel ratio of said mixture for said each of said cylinders, and carries out said feedback control of said air-fuel ratio of said mixture supplied to said each of said cylinders by using the calculated desired value together with said air-fuel ratio estimated by said cylinder-by-cylinder air-fuel ratio-estimating means corresponding to said desired value.

4. An air-fuel ratio control system according to claim 1, wherein said cylinder-by-cylinder air-fuel ratio-estimating means estimates said air-fuel ratio of said mixture supplied to said each of said cylinders, by using a time constant of response delay of said air-fuel ratio-detecting means.

5. An air-fuel ratio control system according to claim 4, wherein said engine has an intake passage, said air-fuel ratio control system including pressure-detecting means arranged in said intake passage for detecting pressure within said intake passage, said air-fuel ratio control system including and engine rotational speed-detecting means for detecting rotational speed of said engine, said time constant being set according to said rotational speed of said engine and said pressure within said intake passage.

6. An air-fuel ratio control system according to claim 1, including second feedback control means for controlling said amount of fuel supplied to said each of said cylinders in a feedback manner responsive to said output from said air-fuel ratio-detecting means with a response speed lower than a response speed of said feedback control means for carrying out said feedback control by using said controller of said recurrence formula type, in a manner such that said air-fuel ratio of said mixture supplied to said each of said cylinders is converged to said desired value, and selecting means for selecting one of said feedback controls means for carrying out said feedback control by using said controller of said recurrence formula type and said second feedback control means, depending upon operating conditions of said engine.

* * * * *